US007344222B2

(12) United States Patent
Nakamura

(10) Patent No.: US 7,344,222 B2
(45) **Date of Patent: *Mar. 18, 2008**

(54) WIPING UNIT FOR LIQUID DROPLET EJECTION HEAD; LIQUID DROPLET EJECTION APPARATUS EQUIPPED THEREWITH; ELECTRO-OPTICAL DEVICE; METHOD OF MANUFACTURING THE SAME; AND ELECTRONIC DEVICE

(75) Inventor: Shinichi Nakamura, Okaya (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/471,312

(22) Filed: Jun. 20, 2006

(65) Prior Publication Data

US 2006/0238563 A1 Oct. 26, 2006

Related U.S. Application Data

(62) Division of application No. 10/731,894, filed on Dec. 9, 2003, now Pat. No. 7,073,886.

(30) Foreign Application Priority Data

Dec. 20, 2002 (JP) ..... 2002-369883

(51) Int. Cl.
*B41J 2/165* (2006.01)

(52) U.S. Cl. ..... 347/33; 347/32

(58) Field of Classification Search ..... 347/33, 347/29, 32, 104
See application file for complete search history.

(56) References Cited

U.S. PATENT DOCUMENTS

| | | | | |
|---|---|---|---|---|
| 4,369,456 | A * | 1/1983 | Cruz-Uribe et al. | 347/33 |
| 6,183,060 | B1 * | 2/2001 | Tokuda | 347/33 |
| 6,554,391 | B1 | 4/2003 | Sharma et al. | |
| 6,692,100 | B2 | 2/2004 | Steinfield et al. | |
| 7,073,886 | B2 * | 7/2006 | Nakamura | 347/33 |

FOREIGN PATENT DOCUMENTS

| | | |
|---|---|---|
| JP | 03-224738 | 10/1991 |
| JP | 06-155754 | 6/1994 |
| JP | 2000-056116 | 2/2000 |
| JP | 2000-251674 | 9/2000 |
| JP | 2001-171135 | 6/2001 |
| JP | 2001-277526 | 10/2001 |

* cited by examiner

*Primary Examiner*—Shih-Wen Hsieh
(74) *Attorney, Agent, or Firm*—Harness, Dickey & Pierce, P.L.C.

(57) ABSTRACT

A wipe-off unit is provided with a cleaning liquid ejection member in a manner to be positioned below a horizontal surface coincident with a nozzle surface and on a sheet feeding side relative to a pressing roller. A wiping sheet is fed from below to the pressing roller through a space between the pressing roller and the cleaning liquid ejection member, and a cleaning liquid is applied to a surface of the wiping sheet.

2 Claims, 17 Drawing Sheets

WIPING UNIT FOR LIQUID DROPLET EJECTION HEAD; LIQUID DROPLET EJECTION APPARATUS EQUIPPED THEREWITH; ELECTRO-OPTICAL DEVICE; METHOD OF MANUFACTURING THE SAME; AND ELECTRONIC DEVICE

CROSS REFERENCE TO RELATED APPLICATIONS

This application is a divisional patent application of U.S. Ser. No. 10/731,894 filed Dec. 9, 2003 now U.S. Pat. No. 7,073,886 which claims priority to JP 2002-369883 filed Dec. 20, 2002, all of which are hereby incorporated by reference.

BACKGROUND OF THE INVENTION

1. Field of the Invention

This invention relates to: a wiping unit for a liquid droplet ejection head in a liquid droplet ejection apparatus (imaging apparatus) which uses a liquid droplet ejection head as represented by an ink jet head; a liquid droplet ejection apparatus equipped with the same; an electro-optical device; a method of manufacturing the electro-optical device; and an electronic device.

2. Description of Related Art

An ink jet head (liquid droplet ejection head) of an ink jet printer can accurately eject minute ink droplets (liquid droplets) in a dot shape. Thus, for example, by using a special ink or a function liquid of a photosensitive resin or the like as an ejected liquid, application of the ink jet printer to a manufacturing field of various products is expected.

For example, it has been considered to manufacture a color filter for a liquid crystal display device, an organic EL display device or the like by using a head unit configured by mounting a liquid droplet ejection head, by ejecting liquid droplets toward the workpiece from an ejection nozzle disposed on a downward nozzle surface of the liquid droplet ejection head while moving the head unit relative to a workpiece such as a color filter substrate.

When an apparatus is paused for a relatively long period of time, such as stopping the apparatus, clogging may occur in the ejection nozzle due to increase in viscosity of a function liquid which remains in the liquid droplet ejection head. Thus, a suction unit having a cap to be firmly fixed to the nozzle surface of the liquid droplet ejection head must be arranged in the imaging apparatus, and residual liquid must be sucked from the ejection nozzle for removal by the suction unit during a pause of imaging work. Moreover, since the nozzle surface is contaminated with the sucked-out function liquid when the suction is carried out, it is preferable to wipe off the nozzle surface to remove a stain after the suction.

Thus, there has conventionally been known a wiping unit which comprises a wipe-off unit on which a pressing member for relatively pressing a wiping sheet to a nozzle surface from below is mounted, and a sheet feeding unit to feed the wiping sheet through the pressing member, which is adapted to move the wipe-off unit integrally with the sheet feeding unit in a predetermined wiping direction parallel to the nozzle surface while feeding the wiping sheet in a state in which the wiping sheet is pressed to the nozzle surface, thereby wiping the nozzle surface with the wiping sheet.

In this wiping unit, the wiping sheet is fed substantially horizontally to the pressing member, a cleaning liquid containing a function liquid solvent is ejected from a cleaning liquid nozzle formed in the center of the pressing member to the wiping sheet fed to the pressing member so that the wiping sheet is permeated with the cleaning liquid to effectively wipe off the function liquid stuck to the nozzle surface.

In such a conventional wiping unit, wide planar distribution of a plurality of liquid droplet ejection heads in a carriage causes a problem of interference of the carriage with a main body portion of the wiping unit. Moreover, since the wiping unit is moved by an X-axis table, and the liquid droplet ejection head (carriage) is moved up and down, there is a problem of a complex structure.

In such a case, a structure may be employed in which the wiping unit is disposed on a machine base, the liquid droplet ejection head is arranged to face this unit, and a wiping sheet is introduced from below. Further, if a plurality of liquid droplet ejection heads overlap each other in a wiping direction, or are arranged in a complex manner, a need arises to dispose a supply of a cleaning liquid in one place of a front side in the wiping direction.

However, in such a structure, a surface of the wiping sheet opposing a cleaning liquid ejection member becomes not a front surface (surface brought into contact with the nozzle surface) but a backside, and a cleaning liquid from the cleaning liquid ejection member is applied on this backside. Here, in order to secure absorbency of a removed object by the wiping sheet, a wiping sheet which has a certain thickness must be used, and it takes time for the cleaning liquid applied on the backside of the wiping sheet to permeate the front surface side of the wiping sheet. Thus, in order to widely spread the front surface of the wiping sheet with the cleaning liquid to thereby improve the wiping performance, a distance between the pressing member and the cleaning liquid ejection member must be set long. As a consequence, a consumption amount of the expensive wiping sheet increases to heighten running costs. Namely, in wiping the nozzle surface, it is necessary to start wiping work after the wiping sheet is subjected to preliminary feeding until a portion of the wiping sheet, on which the cleaning liquid is applied by the cleaning liquid ejection member, reaches the pressing member. If the distance between the pressing member and the cleaning liquid ejection member is set large, the length of the wiping sheet wasted by the preliminary feeding becomes large.

SUMMARY OF THE INVENTION

This invention has an object of providing a wiping unit for a liquid droplet ejection head which can improve wiping performance and reduce a consumption amount of a wiping sheet to the extent possible, a liquid droplet ejection apparatus equipped with the same, an electro-optical device, a method of manufacturing the electro-optical device, and an electronic device.

A wiping unit for a liquid droplet ejection head according to this invention comprises a wipe-off unit having mounted thereon a pressing roller to press a wiping sheet from below to a downward nozzle surface of the liquid droplet ejection head, and a sheet feeding unit for feeding the wiping sheet through the pressing roller such that the wipe-off unit is moved in a predetermined wiping direction parallel to the nozzle surface integrally with the sheet feeding unit to carry out a wiping operation while feeding the wiping sheet in a state in which the wiping sheet is pressed to the nozzle surface, wherein a cleaning liquid ejection member is mounted on the wipe-off unit so as to be positioned below a horizontal surface coincident with the nozzle surface and on a feeding side of the wiping sheet relative to the pressing roller in a state in which the wiping sheet is pressed to the nozzle surface, wherein the wiping sheet is fed from below to the pressing roller through a space between the pressing roller and the cleaning liquid ejection member, and wherein a cleaning liquid is ejected from the cleaning liquid ejection member toward the wiping sheet passing through the space.

According to the above-described arrangement, the surface of the wiping sheet is opposed to the cleaning liquid ejection member, and the cleaning liquid from the cleaning liquid ejection member is applied to the surface of the wiping sheet. Therefore, even if the cleaning liquid ejection member is arranged as close as possible to the pressing roller, a stain of the nozzle surface can be effectively wiped off by spreading the cleaning liquid on the surface of the wiping sheet. As a result, the length of the wiping sheet for a preliminary feeding (a feeding length until that part of the wiping sheet to which the cleaning liquid is applied by means of the cleaning liquid ejection member reaches the pressing roller) can be shortened to the extent possible, and the consumption amount of the wiping sheet can be reduced. Incidentally, since the cleaning liquid ejection member is arranged below the above-described horizontal surface, no interference thereof with the nozzle surface occurs.

By the way, a plurality of head rows made up of a plurality of liquid droplet ejection heads are arranged side by side at intervals in a predetermined direction. In this case, the wiping direction is set identical to the predetermined direction, and the wipe-off unit is moved to the plurality of head rows sequentially to wipe the nozzle surfaces of the liquid droplet ejection heads belonging to each head row. Here, in the movement section of the wipe-off unit positioned between the head rows, the nozzle surface is not wiped. Therefore, in order to prevent wasteful consumption of the wiping sheet and the cleaning liquid, the feeding of the wiping sheet and the ejection of the cleaning liquid are preferably suspended in this movement section.

Further, after the wiping of the nozzle surface, the wipe-off unit is moved in a direction opposite to the wiping direction to return to a home position. In this case, if the wiping sheet is kept pressed to the nozzle surface, there is a possibility of re-sticking of the wiped-off stain to the nozzle surface. Therefore, if the wipe-off unit is arranged to be freely movable vertically, and the wipe-off unit is moved back in its lowered state, the wiping sheet is separated from the nozzle surface. It is thus possible to prevent re-sticking of the stain to the nozzle surface during the back movement.

On the other hand, preferably, the wiping sheet is made of a cloth material of 100% polyester or a cloth material of 100% polypropylene. Moreover, preferably, the thickness of the wiping sheet is in a range of 0.4 mm to 0.6 mm.

According to this arrangement, fiber fluff of the wiping sheet or a compound in a fiber is never dissolved. Moreover, by providing a certain thickness, the amount of a cleaning liquid necessary for the wiping operation can be adequately permeated and held therein.

A liquid droplet ejection apparatus of this invention comprises the wiping unit for the above-described liquid droplet ejection head, the liquid droplet ejection head, and a moving table for moving the liquid droplet ejection head.

According to this arrangement, since the nozzle surface of the liquid droplet ejection head can be managed to be in a state of no stains by the wiping unit, it is possible to maintain stable function liquid ejection and high imaging accuracy.

In this case, preferably, the liquid droplet ejection apparatus further comprises a suction unit arranged adjacently to the wiping unit to suck function liquids from all the nozzles of the liquid droplet ejection heads, and a moving mechanism for integrally moving the suction head and the wiping unit to face the liquid droplet ejection head, respectively.

According to this arrangement, since the suction head and the wiping unit can be integrally moved by the moving mechanism, it is possible to efficiently cause the devices of such a maintenance system to face the liquid droplet ejection head moved to a maintenance position. For example, to solve an ejection failure of the liquid droplet ejection head, suction of function liquid and wiping of the liquid droplet ejection head can be continuously carried out without moving the liquid droplet ejection head.

An electro-optical device of this invention uses the above-described liquid droplet ejection apparatus and ejects a function liquid droplet from the liquid droplet ejection head to a workpiece to form a deposition portion.

Similarly, an electro-optical device manufacturing method of this invention uses the above-described liquid droplet ejection apparatus and ejects a function liquid droplet from the liquid droplet ejection head to a workpiece to form a deposition portion According to these arrangements, since manufacturing is carried out by using the liquid droplet ejection apparatus in which the nozzle surface of the liquid droplet ejection head is cleanly maintained, it is possible to manufacture a highly reliable electro-optical device. Incidentally, as the electro-optical device, a liquid crystal display device, an organic electro-luminescence (EL) device, an electron emission device, a plasma display panel (PDP) device, an electrophoretic display device or the like is conceivable. Incidentally, the electron emission device is a concept which includes a so-called field emission display (FED) device. Further, as the electro-optical device, an apparatus for metal wiring formation, lens formation, resist formation, a light diffusing body formation or the like is conceivable. Additionally, an apparatus for transparent electrode (ITO) formation such as a liquid crystal display device is conceivable.

An electronic device of this invention mounts the above-described electro-optical device or the above-described electro-optical device manufactured by the method of manufacturing the electro-optical device.

In this case, a portable telephone on which a so-called flat panel display is mounted, a personal computer, or various kinds of electric appliances correspond to the electronic device.

DETAILED DESCRIPTION OF THE PREFERRED EMBODIMENTS

Figure 1:
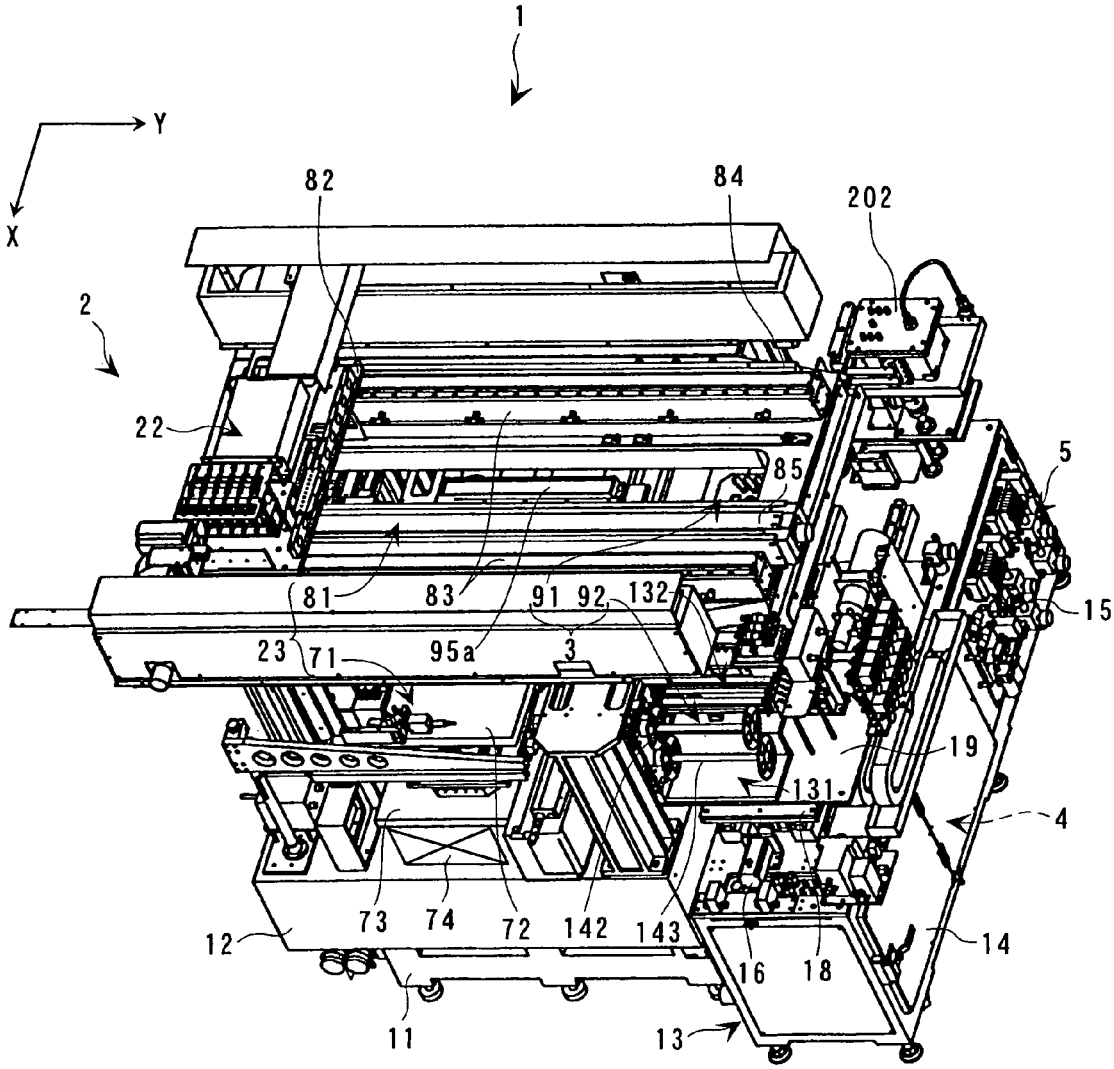
FIG. 1 is an external perspective view of a imaging apparatus of an embodiment.
Figure 2:
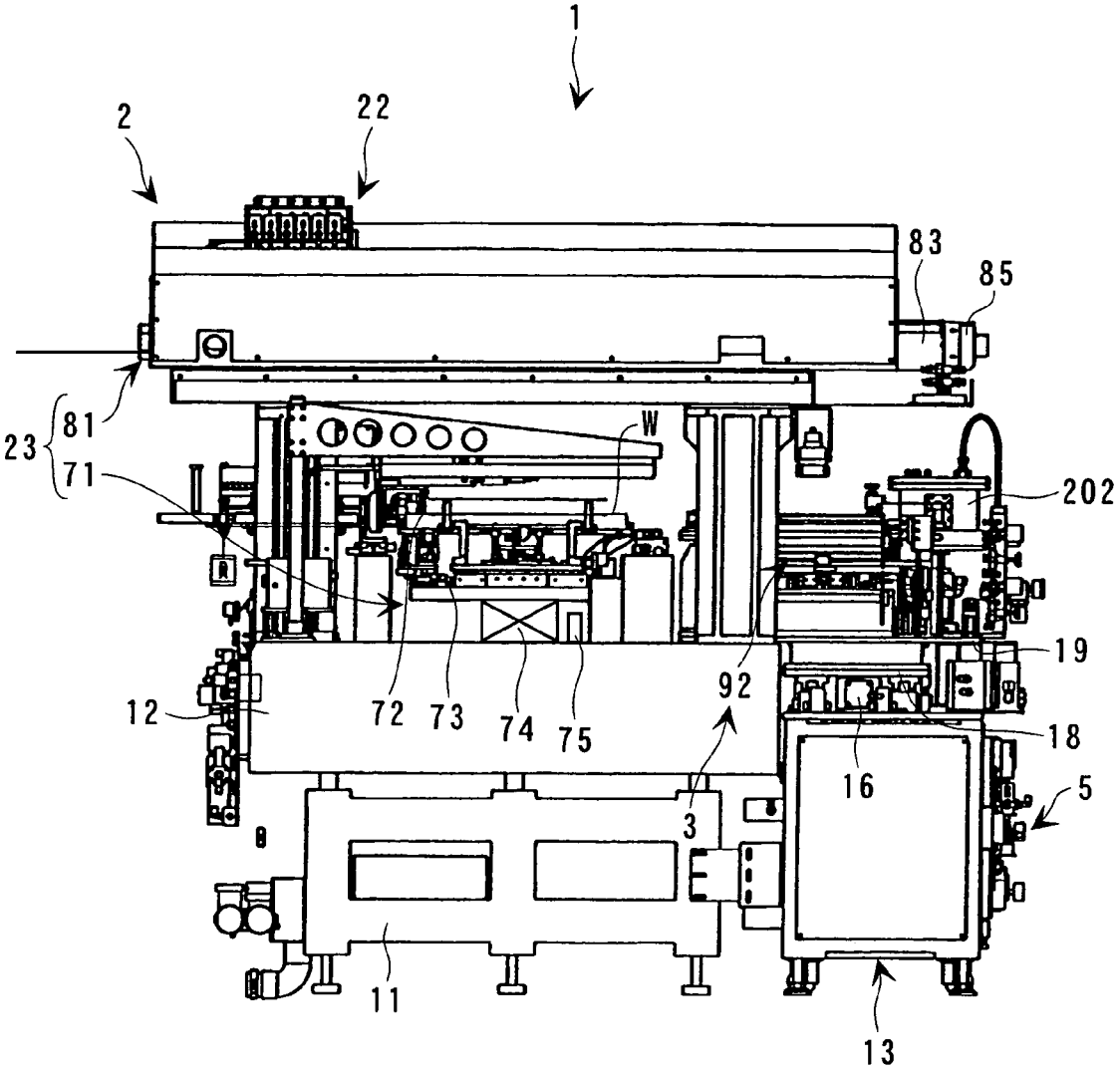
FIG. 2 is a front view of the imaging apparatus of the embodiment.
Figure 3:
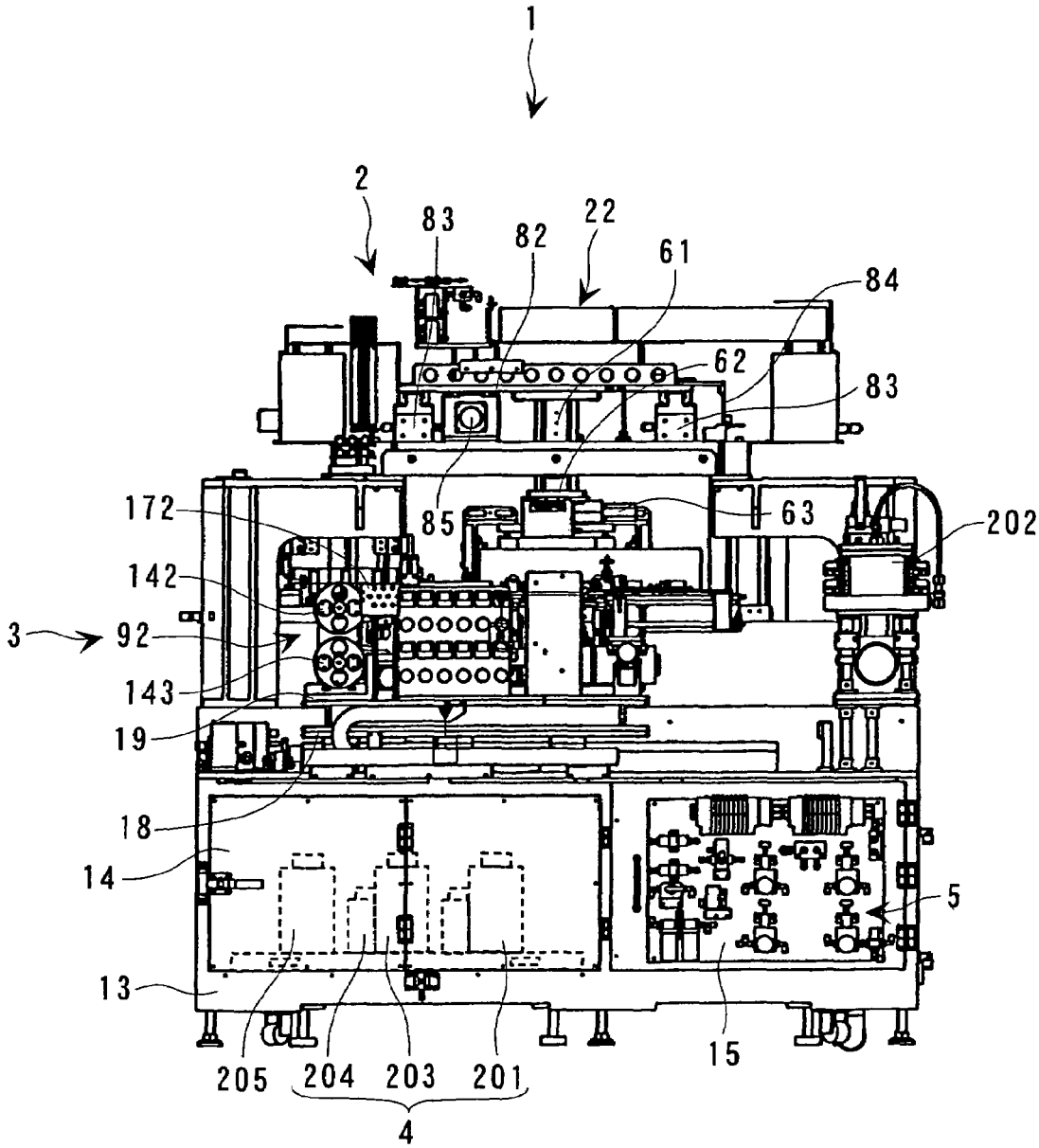
FIG. 3 is a side view of the imaging apparatus of the embodiment as seen from the right side of FIG. 2.
Figure 4:
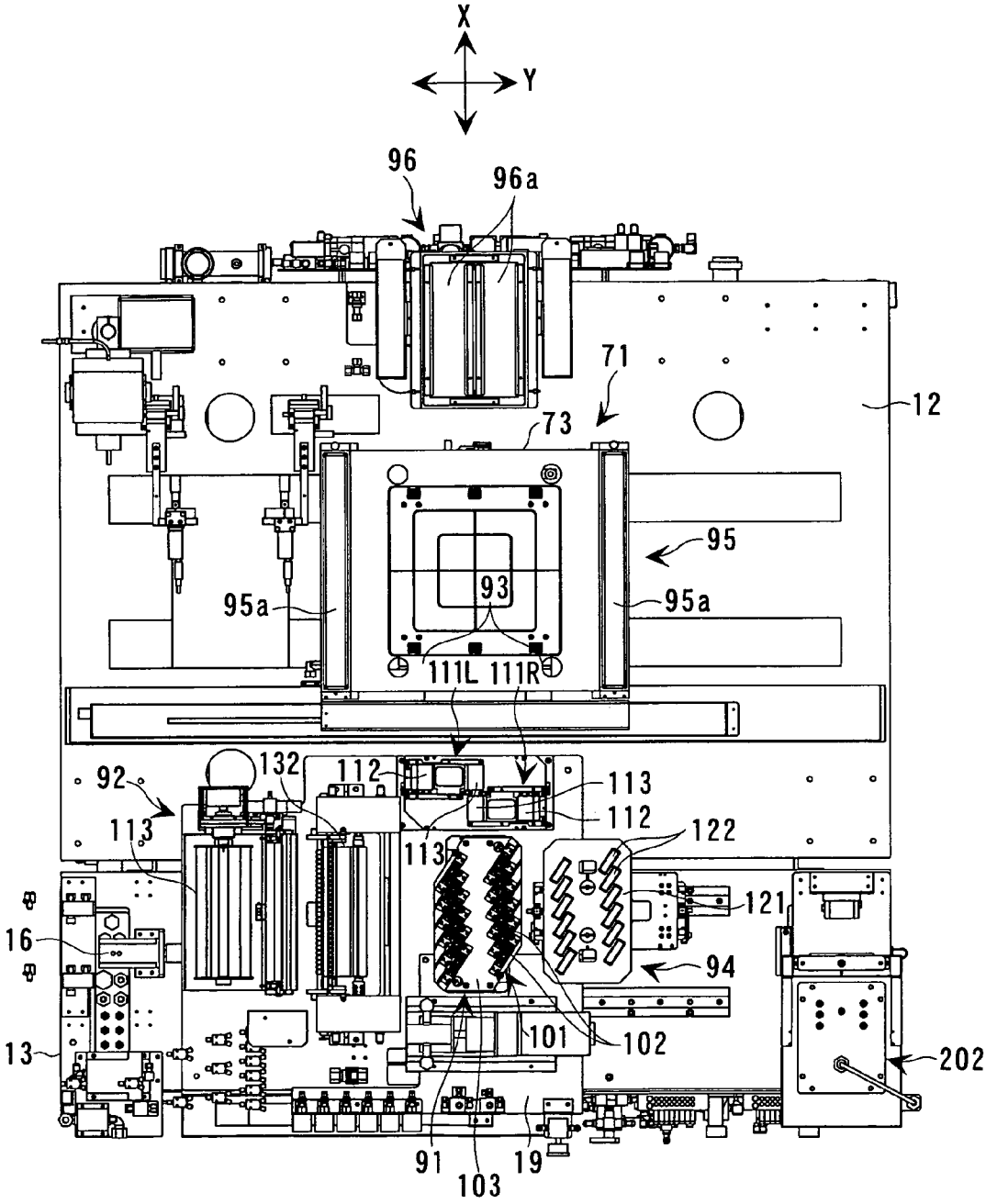
FIG. 4 is a plan view of the partially omitted imaging apparatus of the embodiment.

Herein below, the preferred embodiments of this invention will be described with reference to the accompanying drawings. FIG. 1 is an external perspective view of an imaging apparatus to which this invention is applied. FIG. 2 is a front view of the imaging apparatus to which this invention is applied. FIG. 3 is a right side view of the imaging apparatus to which this invention is applied. FIG. 4 is a plan view of the partially omitted imaging apparatus to which this invention is applied. As described in detail hereinafter, this imaging apparatus 1 introduces a special ink or a function liquid of a light-emitting resin or the like to a liquid droplet ejection head 31 to form a film-forming part on a workpiece W such as a substrate.

As shown in FIGS. 1 to 4, the imaging apparatus 1 is provided with imaging means 2 for ejecting the function liquid while moving the liquid droplet ejection head 31 relative to the workpiece W, maintenance means 3 for performing maintenance of the liquid droplet ejection head 31, function liquid supplying/recovering means 4 for supplying the function liquid to the liquid droplet ejection head 31 and recovering unnecessary function liquid, and air supplying means 5 for supplying compressed air to drive/control each of the means. Each of these means is controlled by control means (not illustrated) while keeping co-relationship with each other. Though not illustrated, aside from the above, there are provided accessory devices such as a workpiece recognition camera for recognizing a position of the workpiece W, a head recognition camera for confirming the position of a head unit 21 (described later) of the imaging means 2, various indicators, or the like, which are also controlled by the control means.

Figure 5:
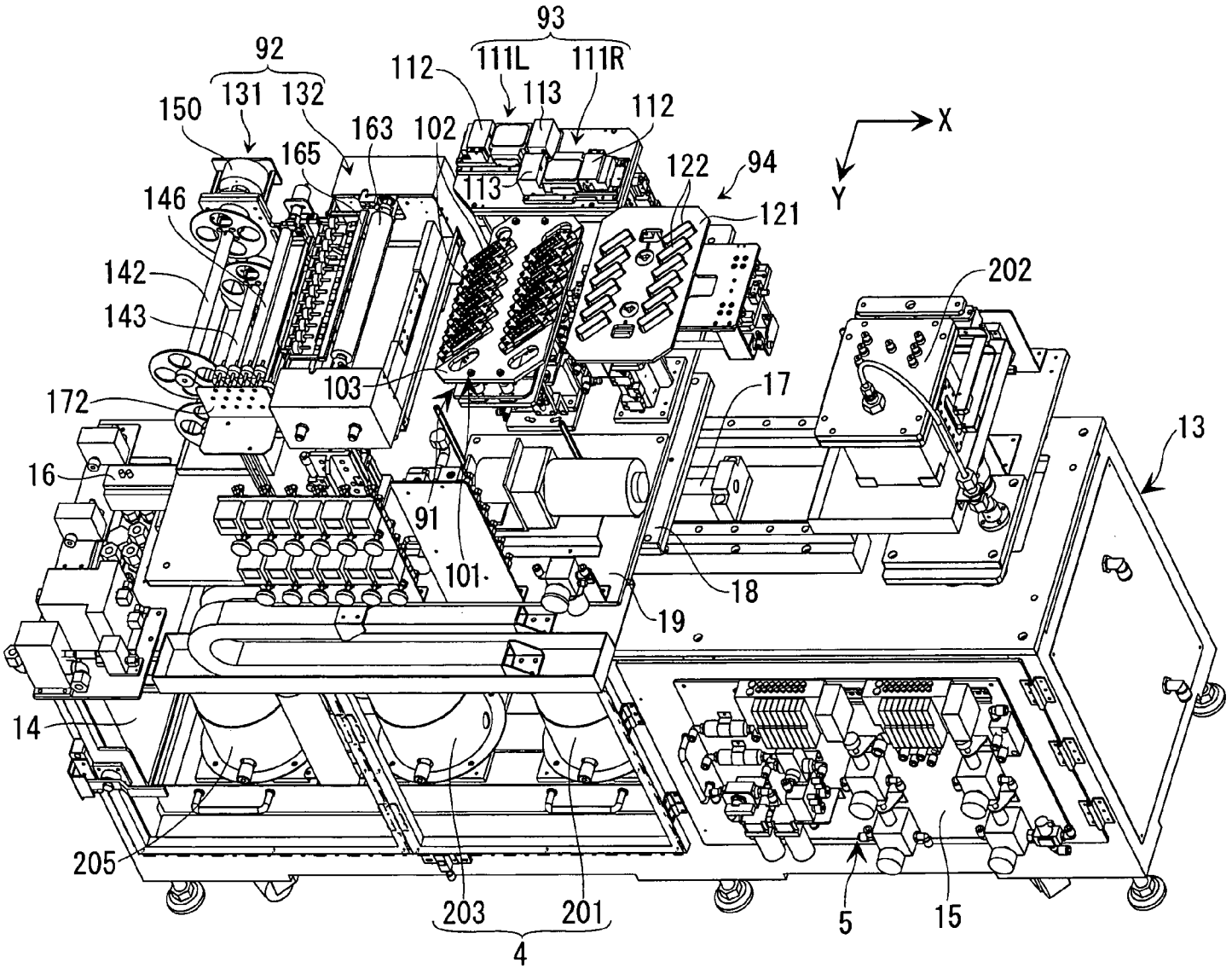
FIG. 5 is a perspective view of maintenance means which includes a wiping unit of the embodiment.

As shown in FIGS. 1 to 4, the imaging means 2 is disposed on a stone surface plate 12 fixed to an upper part of a frame 11 which is constituted by assembling angles into a square form, and major parts of the function liquid supplying/recovering means 4 and the air supplying means 5 are built in a machine base 13 which is added to the frame 11. In the machine base 13, one large and one small, i.e., a total of two housing chambers 14, 15 are formed. A tank or the like of the function liquid supplying/recovering means 4 is housed in the large housing chamber 14, and a main portion of the air supplying means 5 is housed in the small housing chamber 15. Moreover, above the machine base 13, as shown in FIG. 5, there is provided a moving table 18 which is moved in a longitudinal direction (i.e., X-axis direction) of the machine base 13 by a motor 16 through a ball screw 17. To the moving table 18 is fixed a common base 19 which mounts thereon constituting units, to be described later, of the maintenance means 3 of a suction unit 91, a wiping unit 92, a dot omission detection unit 93, and a liquid droplet reception unit 94 for measuring the ejection amount of a function liquid.

This imaging apparatus 1 supplies a function liquid from the function liquid recovering/supplying means 4 to the liquid droplet ejection head 31 while causing the maintenance means 3 to perform maintenance of the liquid droplet ejection head 31 of the imaging means 2, and causes the liquid droplet ejection head 31 to eject the function liquid to the workpiece W. By the way, the function liquid is supplied from a pressure tank 201 housed in the housing chamber 14 through a liquid supply tank 202 arranged above the machine base 13 to the liquid droplet ejection head 31. Hereinafter, each of the means will be described.

The imaging means 2 is provided with a head unit 21 on which a plurality of liquid droplet ejection heads 31 to eject the function liquid are mounted, a main carriage 22 for supporting the head unit 21, and an X/Y moving mechanism 23 for relatively moving the head unit 21 relative to the workpiece W in two scanning directions, i.e., in a main scanning direction (X-axis direction) and in a sub-scanning direction (Y-axis direction) which is orthogonal to the main scanning direction.

Figure 6:
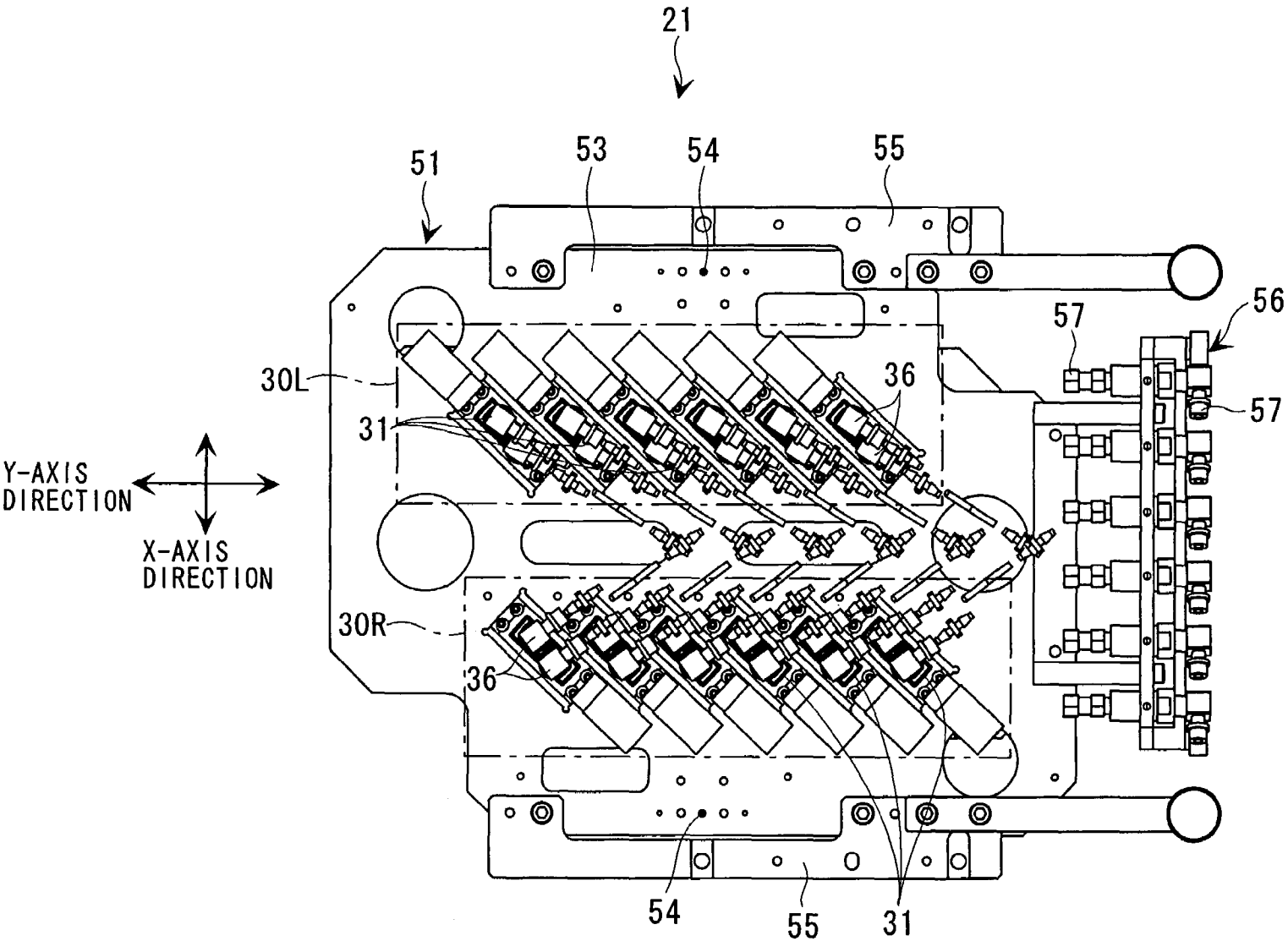
FIG. 6 is a plan view of a head unit of the embodiment.
Figure 7A:
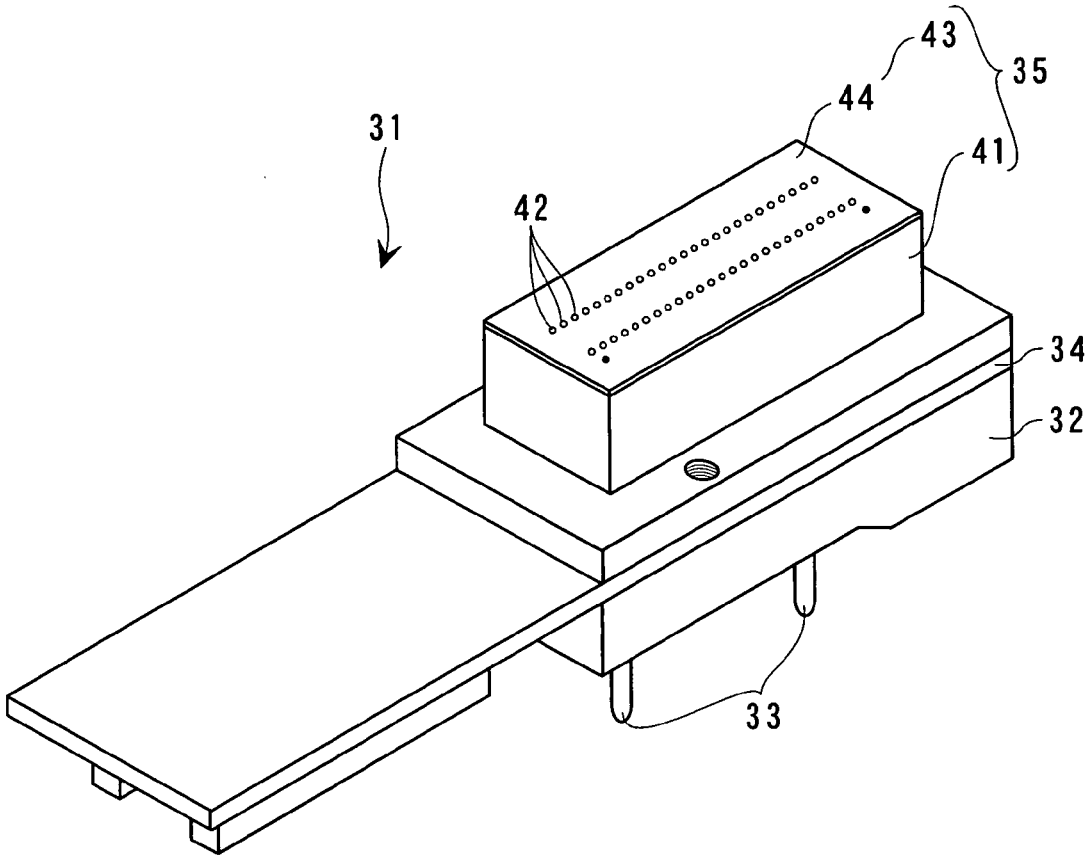
FIG. 7A is a perspective view of a liquid droplet ejection head of the embodiment and FIG. 7B is a sectional view of a main portion of the liquid droplet ejection head.
Figure 7B:
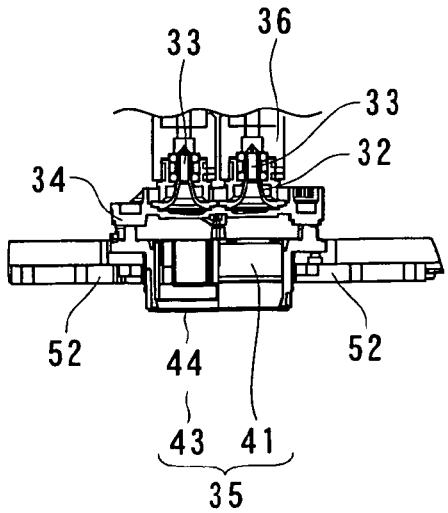

As shown in FIG. 6 and FIGS. 7A and 7B, the head unit 21 is constituted by a plurality (12) of liquid droplet ejection heads 31, a sub-carriage 51 for mounting thereon these liquid droplet ejection heads 31, and a head holding member 52 for mounting each of the liquid droplet ejection heads 31 on the sub-carriage 51 while projecting the nozzle surface 44 beyond the bottom surface of the head holding member 52. The twelve liquid droplet ejection heads 31 are divided into two head rows 30L, 30R, each having six heads, and are disposed on the sub-carriage 51 at a distance there between in the main scanning direction (X-axis direction). Moreover, each of the liquid droplet ejection heads 31 is disposed at an inclination by a predetermined angle so as to secure a sufficient application density of the function liquid on the workpiece W. Further, each of the liquid droplet ejection heads 31 of one head row 30L and the other head row 30R is disposed by being shifted from each other in position in the sub-scanning direction (Y-axis direction), and ejection nozzles 42 of the liquid droplet ejection heads 31 are arranged continuously (partially overlapping each other) in the sub-scanning direction. By the way, in case a sufficient application density of the function liquid to the workpiece W can be secured by constituting the liquid droplet ejection heads 31 by exclusively used components or the like, it is not necessary to take the trouble of setting the liquid droplet ejection heads 31 in an inclined manner.

As shown in FIG. 6, the liquid droplet ejection head 31 is a so-called double type, and is provided with a function liquid introduction part 32 having a double connection needle 33, a double head substrate 34 which is connected to the function liquid introduction part 32, and a head main body 35 which is connected to the lower side of the function liquid introduction part 32 and which has formed therein a head inner passage to be filled with the function liquid. Each of the connection needles 33 is connected through a piping adaptor 36 to the liquid supply tank 202 of the function liquid supplying/recovering means 4, and the function liquid introduction part 32 is arranged to receive the function liquid supplied through the connection needle 33. The head main body 35 is provided with a double pump part 41, and a head plate 43 having a nozzle surface 44 on which a large number of ejection nozzles 42 are formed. The liquid droplet ejection head 31 is arranged to eject liquid droplets from the ejection nozzle 42 by the operation of the pump part 41. Incidentally, the nozzle surface 44 has formed therein two rows of ejection nozzles made up of a large number of ejection nozzles 42.

As shown in FIG. 5, the sub-carriage 51 is provided with a partially notched main body plate 53, a pair of left and right reference pins 54 disposed in a middle position as seen in a longitudinal direction of the main body plate 53, and a pair of left and right supporting members 55 attached to both long side parts of the main plate 53. The pair of reference pins 54 serve as references for positioning the sub-carriage 51 (head unit 21) in X-axis, Y-axis and Θ-axis directions (position recognition) on the assumption of image recognition. The supporting member 55 becomes a fixing portion when the head unit 21 is fixed to the main carriage 22. Furthermore, in the sub-carriage 51, a piping joint 56 is disposed to connect each of the liquid droplet ejection heads 31 and the liquid supply tank 202 through piping. The piping joint 56 has twelve sockets 57 which are used for connection, at one end thereof, to a head side piping member from the piping adaptor 36 connected to (the connection needle 33 of) each of the liquid droplet ejection heads 31 and for connection, at the other end thereof, to an apparatus side piping member from the liquid supply tank 202.

As shown in FIG. 3, the main carriage 22 is constituted by a suspension member 61 which is of I-shape in outer appearance and which is fixed to a bridge plate 82 (to be described later) from the lower side thereof, a Θ table 62 attached to a bottom surface of the suspension member 61, and a carriage main body 63 which is mounted in a lower portion of the Θ table 62 in a suspended manner. The carriage main body 63 has a square opening for loosely fitting the head unit 21 there through so that the head unit 21 can be positioned and fixed.

As shown in FIGS. 1 through 3, the X/Y moving mechanism 23 is fixed to the above-described stone surface plate 12 to cause the workpiece W to perform main scanning (X-axis direction) and to cause the head unit 21 to perform sub-scanning (Y-axis direction) through the main carriage 22. The X/Y moving mechanism 23 is provided with an X-axis table 71 which is fixed by matching its axis line with a center line along a long side of the stone surface plate 12, and a Y-axis table 81 whose axis line is matched with a center line along a short side of the stone surface plate 12 over the X-axis table 71.

The X-axis table 71 is constituted by a suction table 72 for sucking the workpiece W in position by air suction, a Θ table 73 for supporting the suction table 72, an X-axis air slider 74 for supporting the Θ table 73 in a manner freely slidable in the X-axis direction, an X-axis linear motor (not illustrated) for moving the workpiece W on the suction table 72 in the X-axis direction through the Θ table 73, and an X-axis linear scale 75 disposed adjacent to the X-axis air slider 74. Main scanning of the liquid droplet ejection head 31 is carried out by driving an X-axis linear motor in such a manner that the suction table 72 and the Θ table 73 to which the workpiece W is sucked are reciprocated in the X-axis direction with the X-axis air slider 74 serving as a guide.

The Y-axis table 81 is provided with a bridge plate 82 for suspending the main carriage 22, a pair of Y-axis sliders 83 for supporting the bridge plate 82 at both ends so as to be freely slidable in the Y-axis direction, a Y-axis linear scale 84 disposed adjacent to the Y-axis sliders 83, a Y-axis ball screw 85 for moving the bridge plate 82 in the Y-axis direction through guidance of the pair of Y-axis sliders 83, and a Y-axis motor (not illustrated) for rotating the Y-axis ball screw 85 forward/backward. The Y-axis motor is constituted by a servo motor and, when the Y-axis motor is rotated forward/backward, the bridge plate 82 engaged therewith through the Y-axis ball screw 85 is moved in the Y-axis direction through guidance of the pair of Y-axis sliders 83. Namely, accompanied by the movement of the bridge plate 82, the main carriage 22 (head unit 21) performs the reciprocating movement in the Y-axis direction, whereby the sub-scanning of the liquid droplet ejection heads 31 is performed. In FIG. 4, the Y-axis table 81 and the Θ table 73 are omitted.

Now, a series of operations of the imaging means 2 will be briefly described. First, as a preparation before imaging work to eject the function liquid to the workpiece W, after the position of the head unit 21 is corrected by the head recognition camera, the position of the workpiece W set in position on the suction table 72 is corrected by the workpiece recognition camera. Subsequently, the workpiece W is reciprocated in the main scanning (X-axis) direction by the X-axis table 71, and the plurality of liquid droplet ejection heads 31 are driven to execute a selective ejection operation of the liquid droplets to the workpiece W. Then, after the workpiece W is moved back, the head unit 21 is moved in the sub-scanning (Y-axis) direction by the Y-axis table 81, and reciprocation of the workpiece W in the main scanning direction and driving of the liquid droplet ejection heads 31 are carried out again. According to this embodiment, it is so arranged that the workpiece W is moved in the main scanning direction with respect to the head unit 21. However, an arrangement may also be made such that the head unit 21 is moved in the main scanning direction. Moreover, a constitution may be employed in which the workpiece W is fixed so that the head unit 21 is moved in the main scanning direction and in the sub-scanning direction.

Next, each of the constituting units of the maintenance means 3 will be described. The maintenance means 3 is substantially made up of the suction unit 91, the wiping unit 92, the dot omission detection unit 93, and the liquid droplet reception unit 94 on the above-described common base 19. The head unit 21 is moved to a maintenance position above the machine base 13 during a pause of the imaging work. The common base 19 is moved through the moving table 18 in this state to selectively cause the suction unit 91, the wiping unit 92, and the liquid droplet reception unit 94 to face a portion directly below the head unit 21.

The suction unit 91 has a function of a flushing box that forcibly sucks the function liquid from the liquid droplet ejection heads 31 and also receives ejection of the function liquid from the liquid droplet ejection heads 31. The suction unit 91 is provided with a vertically movable cap unit 101 which faces the portion directly below the head unit 21 at the maintenance position when the common base 19 (moving table 18) is at a home position (position shown in FIGS. 4 and 5).

The cap unit 101 is constituted in such a manner that twelve caps 102 are disposed on a cap base 103 so as to correspond to the arrangement of the twelve liquid droplet ejection heads 31 mounted on the head unit 21, and each cap 102 is arranged to be closely fitted to each of the corresponding liquid droplet ejection heads 31 respectively.

When the liquid droplet ejection heads 31 of the head unit 21 are filled with the function liquid, or when the viscosity-increased function liquid in the liquid droplet ejection heads 31 is removed, each of the caps 102 is closely fitted to the nozzle surface 44 of each of the liquid droplet ejection heads 31 to thereby execute pump suction, and the sucked function liquid is recovered in a reutilization tank 203 disposed in the housing chamber 14. During a non-operation of the apparatus, each cap 102 is closely fitted to the nozzle surface 44 of each of the liquid droplet ejection heads 31 for the maintenance of the liquid droplet ejection heads 31 (drying prevention of the function liquid or the like). Further, when the imaging work is stopped because of workpiece replacement or the like, each cap 102 is slightly separated from the nozzle surface 44 of the liquid droplet ejection head 31 to execute flushing (preliminary ejection).

By the way, the flushing operation (preliminary ejection) by the liquid droplet ejection heads 31 is executed even during the imaging work. For that purpose, a flushing unit 95 having a pair of flushing boxes 95*a* fixed to sandwich the suction table 71 is disposed on the Θ table 73 of the X-axis table 71 (see FIG. 4). As the flushing boxes 95*a* are moved together with the Θ table 73 during main scanning, the head unit 21 or the like is not moved for the flushing operation. In other words, since the flushing boxes 95*a* are moved together with the workpiece W toward the head unit 21, a sequential flushing operation can be carried out from the ejection nozzle 42 of the liquid droplet ejection head 31 which faces the flushing box 95*a*. The function liquid received by the flushing boxes 95*a* is stored in a waste liquid tank 204 disposed in the housing chamber 14. Further, on a side portion opposite to the machine base 13 of the stone surface plate 12, there is disposed a spare flushing unit 96 having a pair of flushing boxes 96*a* corresponding to the two head rows 30L and 30R of the head unit 21.

The dot omission detection unit 93 detects whether liquid droplets are surely ejected or not from all the ejection nozzles 42 of the liquid droplet ejection heads 31, in other words, detects whether or not nozzle clogging or the like occurs in the liquid droplet ejection heads 31. The dot omission detection unit 93 is constituted by a pair of optical detectors 111L and 111R disposed corresponding to the two head rows 30L and 30R of the head unit 21. Each of the detectors 111L and 111R causes a light emitting element 112 such as laser diodes and a light receiving element 113 to be opposed to each other, and detects dot omission (ejection failure) based on whether or not ejected liquid droplets block an optical path between the elements 112 and 113. Then, while the head unit 21 is moved in the Y-axis direction so as to pass the liquid droplet ejection heads 31 of the head rows 30L, 30R through portions directly above the detectors 111L, 111R, liquid droplets are sequentially ejected from each of the ejection nozzles 42 to inspect dot omission.

The liquid droplet reception unit 94 is used to measure the ejection amount (weight) of liquid droplets for each of the liquid droplet ejection heads 31, and is provided with a mounting base 121 arranged to face the portion directly below the head unit 21 at the maintenance position when the common base 19 is moved from the home position to the left as seen in FIGS. 4 and 5, and twelve reception containers 122 mounted on the mounting base 121 corresponding to the twelve liquid droplet ejection heads 31 of the head unit 21. When the ejection amount of the liquid droplets is measured, the liquid droplets are ejected from the liquid droplet ejection head 31 toward the reception container 122 by a predetermined number of times, and the reception container 122 is transferred to an electronic scale (not illustrated) to measure the weight of liquid droplets in the reception container 122.

The wiping unit 92 wipes the nozzle surface 44 of the liquid droplet ejection head 31 stained by adhesion of the function liquid due to suction (cleaning) or the like of the liquid droplet ejection head 31, by using a wiping sheet 130 (see FIG. 14), and is provided with a sheet feeding unit 131 and a wipe-off unit 132 which are separately and independently constituted. The sheet feeding unit 131 and the wipe-off unit 132 are arranged side by side in the X-axis direction on the common base 19 in a state in which the wipe-off unit 132 is positioned on the suction unit 91 side. The movement of the moving table 18 toward the head unit 21 staying at the maintenance position causes the wipe-off unit 132 to move integrally with the sheet feeding unit 131 in one of the X-axis direction (right in FIGS. 4 and 5) which is a wiping direction, whereby the nozzle surfaces 44 of all the twelve liquid droplet ejection heads 31 of the head unit 21 are wiped.

Figure 8:
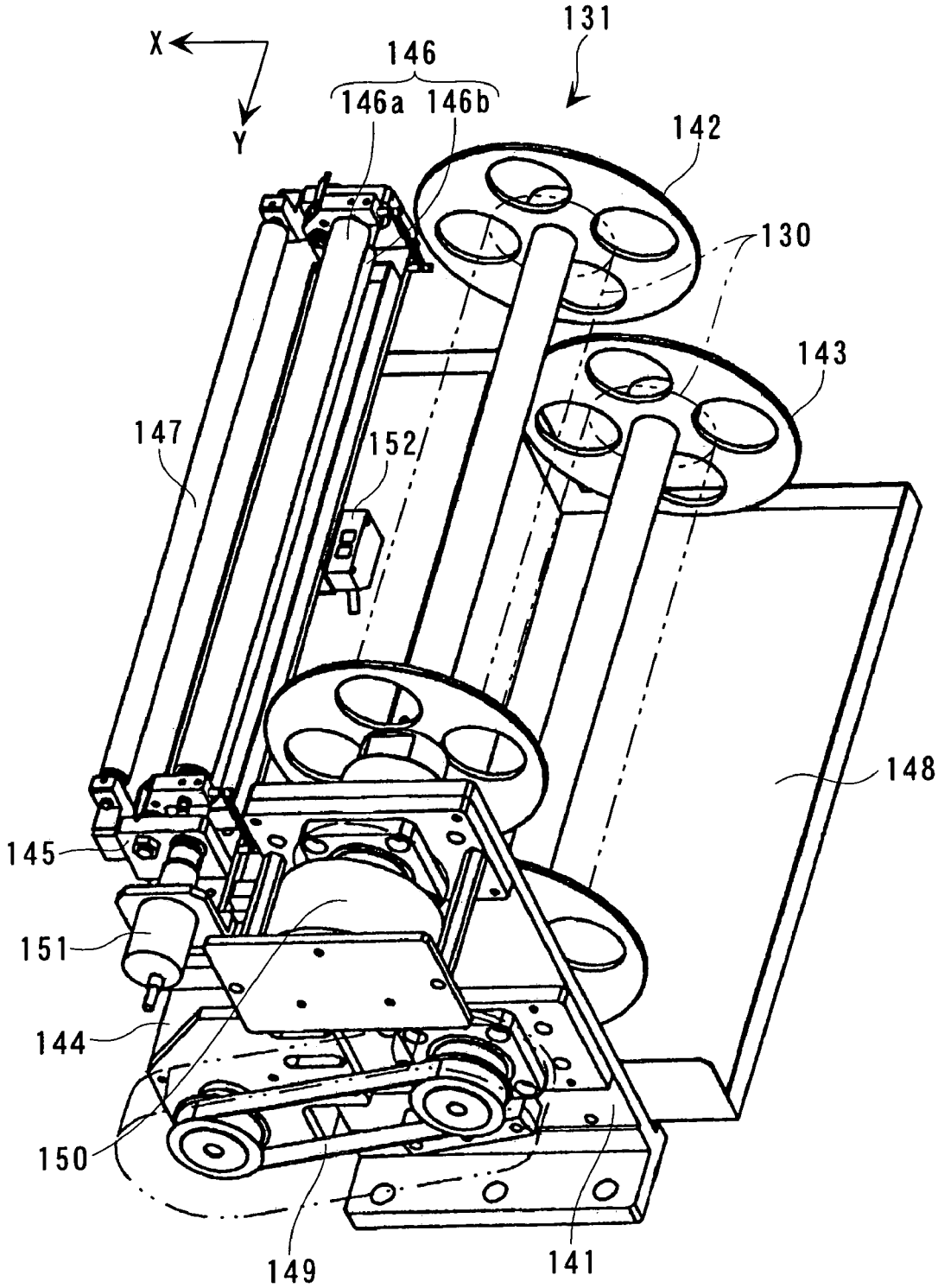
FIG. 8 is a perspective view of a sheet feeding unit of the embodiment.
Figure 9:
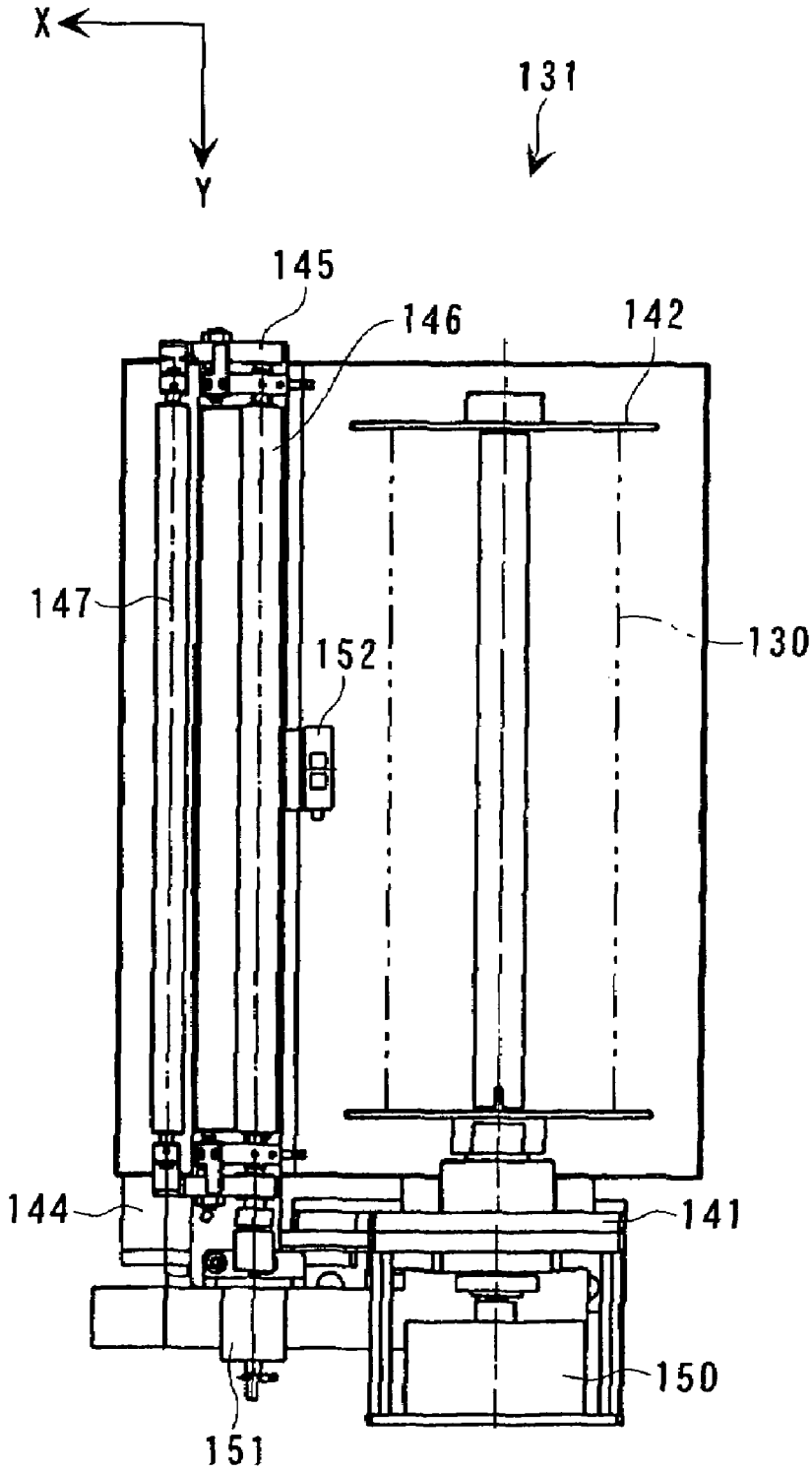
FIG. 9 is a plan view of the sheet feeding unit of the embodiment.
Figure 10:
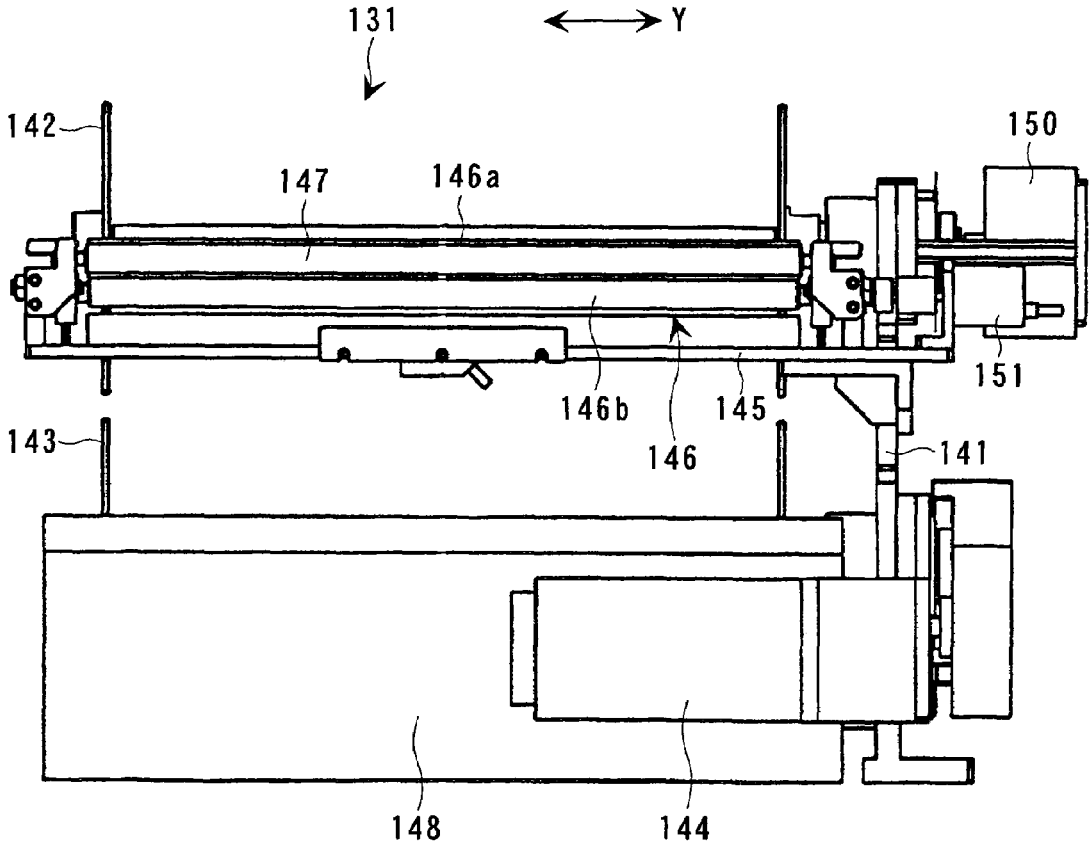
FIG. 10 is a front view of the sheet feeding unit of the embodiment as seen from the left side of FIG. 9.

As shown in FIGS. 8, 9 and 10, the sheet feeding unit 131 includes an upper supply reel 142 and a lower take-up reel 143 supported on a frame 141 erected on one side of the Y-axis direction in cantilever so as to be freely detached, and a take-up motor 144 for winding and rotating the take-up reel 143. Moreover, a sub-frame 145 is fixed to an upper side of the frame 141 and, by this sub-frame 145, a speed detection roller 146 and a guide roller 147 are supported at both ends thereof so as to be positioned in front of the supply reel 142. Further, below these constituting elements, a cleaning liquid pan 148 is arranged to receive a cleaning liquid.

A roll-shaped wiping sheet 130 is inserted and fixed in the supply reel 142, and the wiping sheet 130 supplied from the supply reel 142 is fed through the speed detection roller 146 and the guide roller 147 to the wipe-off unit 132. A timing belt 149 is laid between the take-up reel 143 and the take-up motor 144, and the take-up reel 143 is rotated by the take-up motor 144 to wind the wiping sheet 130.

As described in detail hereinafter, a motor (feeding motor 164) for feeding the wiping sheet 130 is also disposed on the wipe-off unit 132, and the supply reel 142 is rotated while being braked by a torque limiter 150 disposed therein against the feeding motor 164. The speed detection roller 146 is a grip roller which includes upper and lower, i.e., two rollers 146*a* and 146*b*, which freely rotate, and controls the take-up motor 144 by a speed detector 151 disposed therein. In other words, the supply reel 142 feeds the wiping sheet 130 in its tense state, while the take-up reel 143 winds the wiping sheet 130 so as to prevent it from slackening.

Moreover, an optical sheet detector 152 is arranged below a sheet traveling path portion between the supply reel 142 and the speed detection roller 146. When passage of a tail end of the wiping sheet 130 supplied from the supply reel 142 is detected by the sheet detector 152, a replacement command of the supply reel 142 and the take-up reel 143 is issued.

Figure 11:
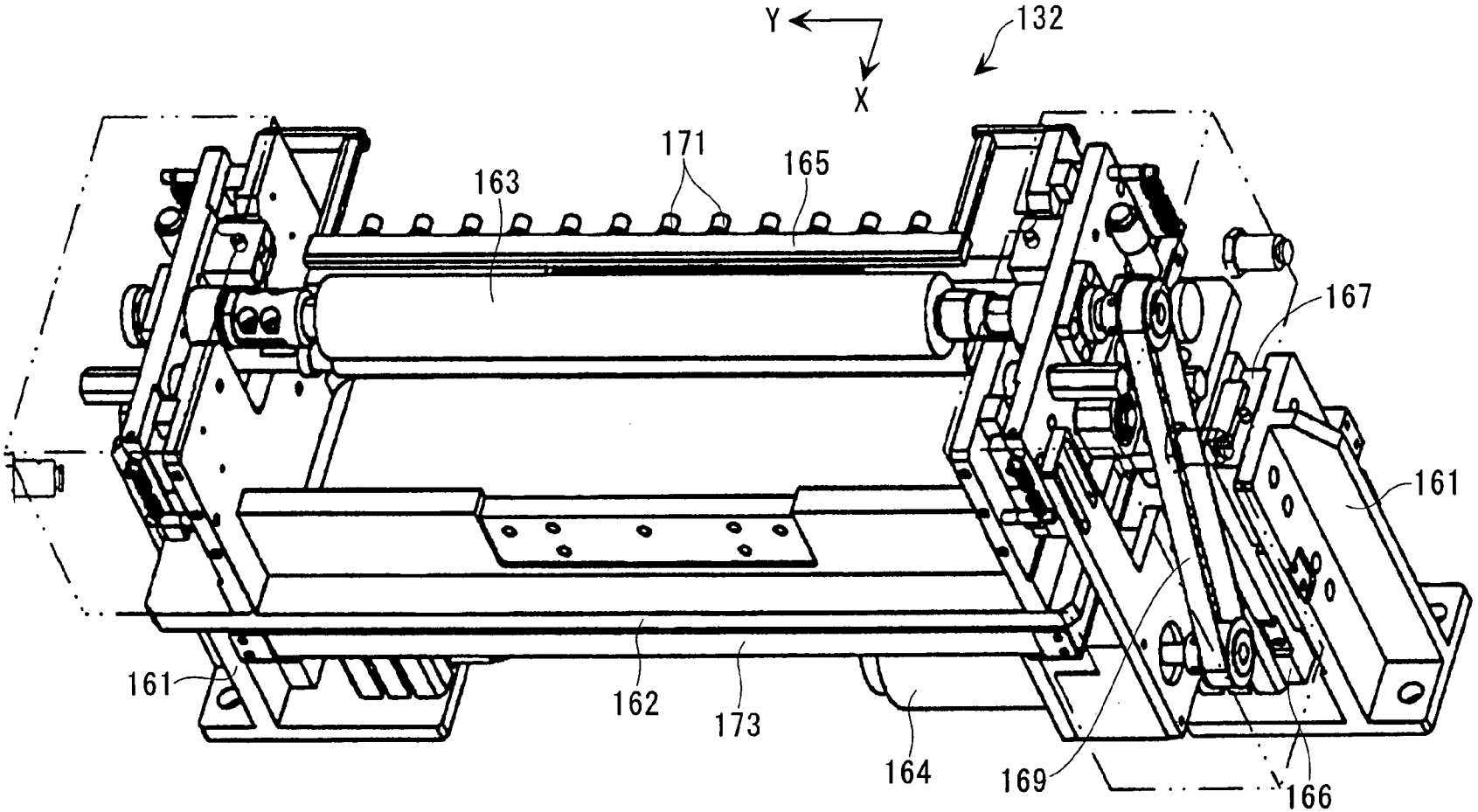
FIG. 11 is a perspective view of a wipe-off unit of the embodiment.
Figure 12:
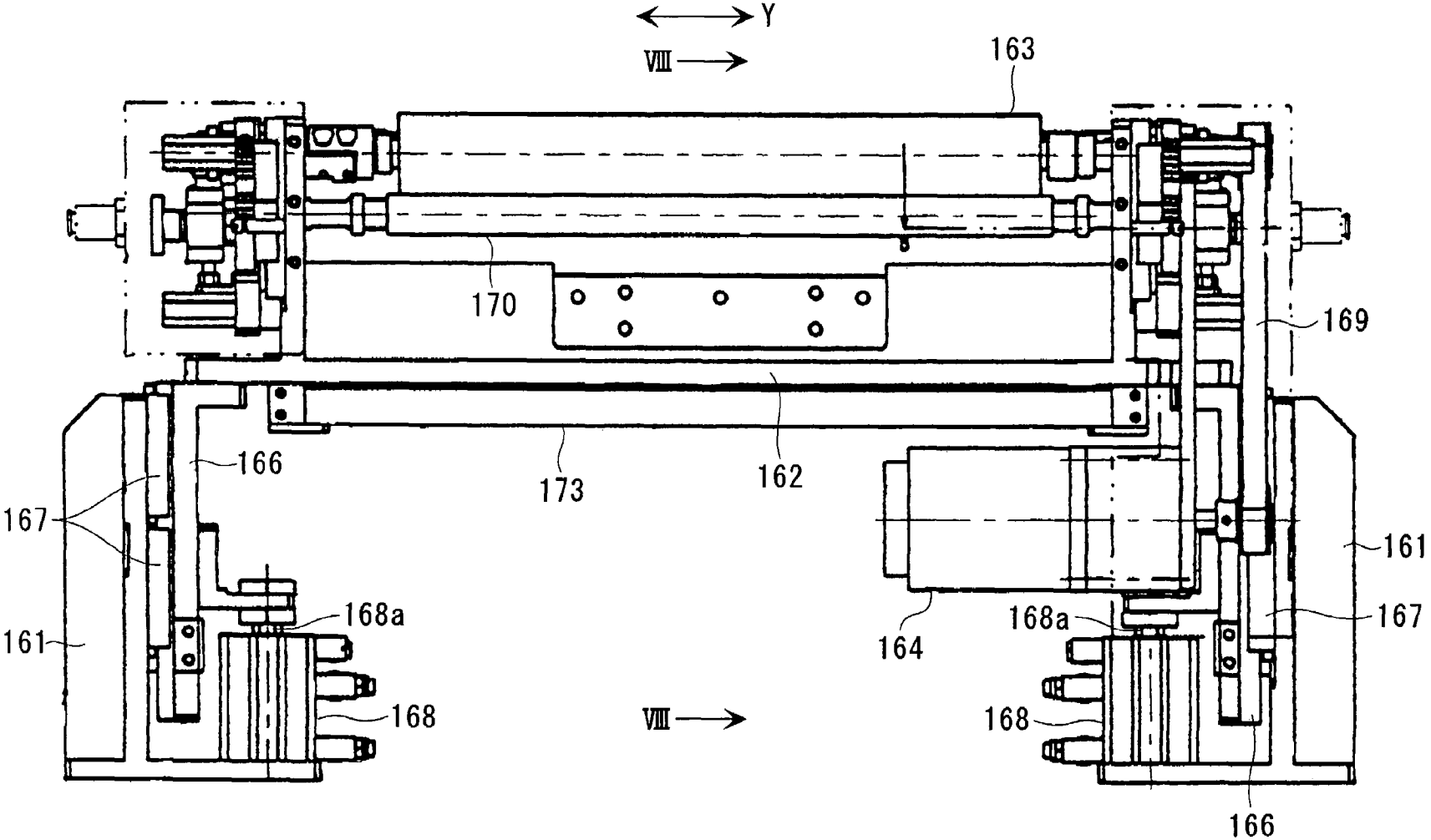
FIG. 12 is a front view of the wipe-off unit of the embodiment.
Figure 13:
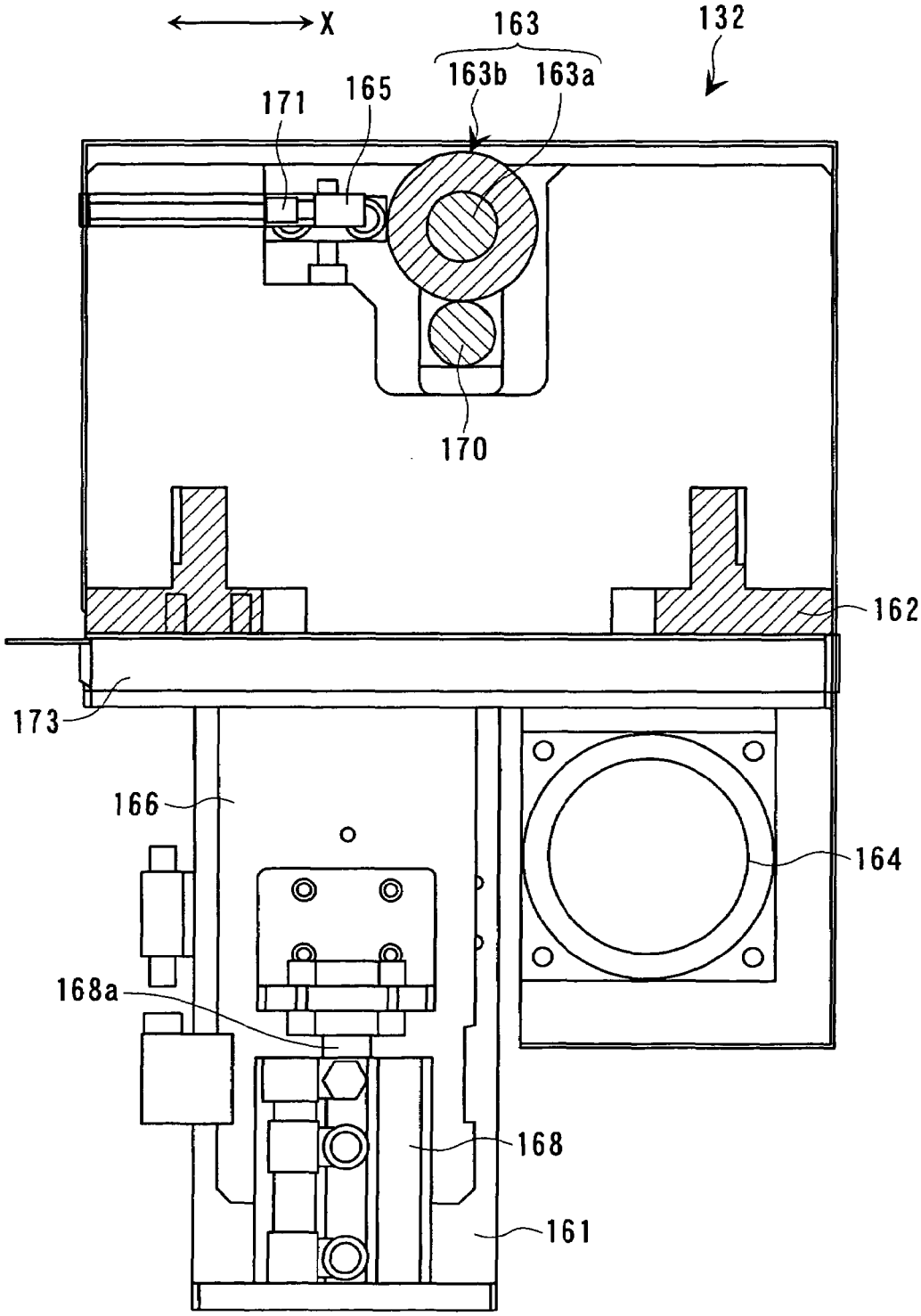
FIG. 13 is a sectional view of the wipe-off unit of the embodiment cut along the line XII-XII of FIG. 12.

As shown in FIGS. 11, 12 and 13, the wipe-off unit 132 is provided with a vertical moving frame 162 supported to move vertically between a pair of stands 161, 161 erected on both sides of the Y-axis direction, a pressing roller 163 rotatably supported at both ends on the vertical moving frame 162, a feeding motor 164 for rotating the pressing roller 163, and a cleaning liquid ejection head (cleaning liquid ejection member) 165 for supplying a cleaning liquid containing a function liquid solvent to the wiping sheet 130 fed to the pressing roller 163.

A pair of leg pieces 166 are vertically disposed on both sides of the Y-axis direction of the vertical moving frame 162, and each of the leg pieces 166 is engaged with a guide 167 attached to an inner side of the stand 161, so as to be freely movable up and down. In addition, an air cylinder 168 is erected on a base portion of the stand 161, and its piston rod 168*a* is connected to each of the leg pieces 166. By the operation of the air cylinder 168, the vertical moving frame 162, the pressing roller 163 supported thereon, the cleaning liquid ejection head 165, and the like are arranged to be moved up and down.

Figure 14A:
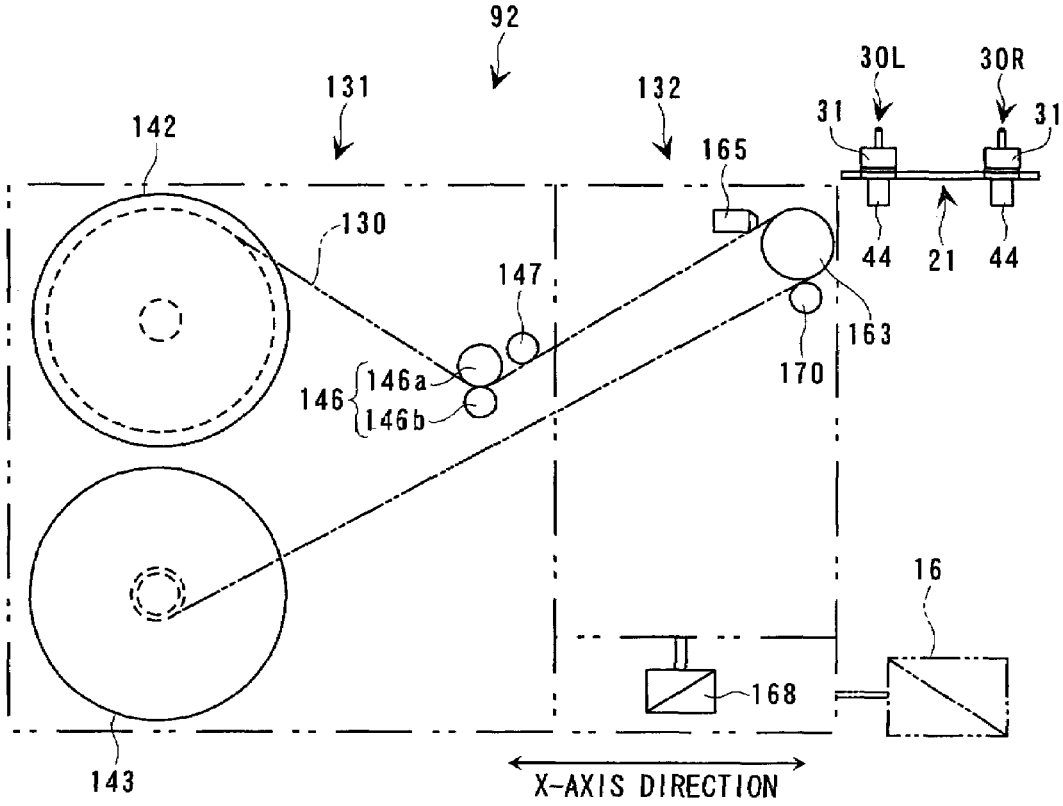
FIG. 14A is a schematic view of the wipe-off unit of the embodiment and FIG. 14B is a view showing a positional relation of a pressing roller and a cleaning droplet ejection head relative to a nozzle surface.
Figure 14B:
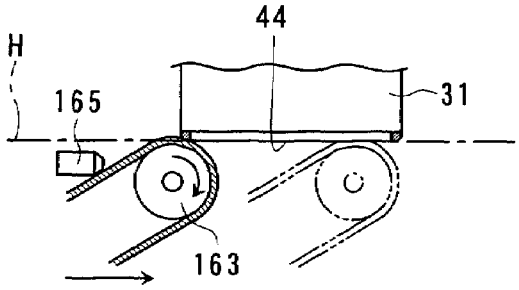

The pressing roller 163 is rotated and driven through the timing belt 169 by the feeding motor 164. Moreover, a pinch roller 170 is rotatably supported on the vertical moving frame 162 along a bottom side of the pressing roller 163. As shown in FIG. 14A, that part of the wiping sheet 130 which is fed out from the pressing roller 163 toward the take-up reel 143 is held between the pressing roller 163 and the pinch roller 170 to prevent slippage of the wiping sheet 130 relative to the pressing roller 163 and, by rotation of the pressing roller 163, the wiping sheet 130 is surely fed to the pressing roller 163.

The pressing roller 163 is constituted by an elastic roller in which an elastic body 163*b* such as rubber is fixed on an outer periphery of a shaft portion 163*a*. Then, in a state in which the wipe-off unit 132 (vertical moving frame 162) is raised to a lifted end position, a position of an uppermost part of the wiping sheet 130 wound around the pressing roller 163 is set slightly higher than the position of the nozzle surface 44 of the liquid droplet ejection head 31 mounted on the head unit 21. When the wipe-off unit 132 is moved in one of the X-axis direction to cause the pressing roller 163 to intersect a portion directly below the nozzle surface 44, the wiping sheet 130 and the pressing roller 163 are compressed downward, and an elastic restoring force thereof presses the wiping sheet 130 to the nozzle surface 44 (see FIG. 14B).

The cleaning liquid ejection head 165 is disposed on the feeding side of the wiping sheet 130 relative to the pressing roller 163 and is arranged close to and opposite to the pressing roller 163. And, as shown in FIG. 14A, the wiping sheet 130 sent through the above-described guide roller 147 is fed from below through a space between the pressing roller 163 and the cleaning liquid ejection head 165 to the pressing roller 163. Here, a number of nozzle holes (not illustrated) are disposed in a sidewise array so as to match the width of the wiping sheet 130 on a front part of the cleaning liquid ejection head 165 facing the pressing roller 163 side. On the other hand, a plurality of connectors 171 for piping are disposed on a rear surface of the cleaning liquid ejection head 165.

Moreover, a cleaning liquid tank 205 is housed in the housing chamber 14 and, on the common base 19, a distribution panel 172 for piping (see FIG. 5) is arranged so as to be positioned on the front side of the sheet feeding unit 131. Then, a cleaning liquid is supplied from the cleaning liquid tank 205 through the distribution panel 172 and the connector 171 to the cleaning liquid ejection head 165, and the cleaning liquid is ejected through the nozzle hole of the cleaning liquid ejection head 165 to the wiping sheet 130 which passes through the space between the pressing roller 163 and the cleaning liquid ejection head 165.

By the way, the wiping sheet 130 is constituted by a wiper material (cloth material) of 100% polyester or 100% polypropylene in which an influence of dissolution of the sheet by a solvent of the cleaning liquid is relatively small, and it is preferable that the thickness of the sheet be set to 0.4 mm or more in order to secure absorbency of a wiped-off stain (preferably 0.4 mm to 0.6 mm). In this case, if the cleaning liquid is applied from the backside of the wiping sheet 130, it takes time for the cleaning liquid to permeate to the front surface (surface to be brought into contact with the nozzle surface 44) of the wiping sheet 130.

Thus, to efficiently wipe off a stain of the nozzle surface 44 by spreading the cleaning liquid on the front surface of the wiping sheet 130, it is necessary to set a long distance between the pressing roller 163 and the cleaning liquid ejection head 165. Here, when the nozzle surface 44 is wiped, wiping work must be started after the wiping sheet 130 is fed preliminarily until that part of the wiping sheet 130 to which the cleaning liquid is applied by the cleaning liquid ejection head 165 reaches the uppermost part of the pressing roller 163. When the long distance is set between the pressing roller 163 and the cleaning liquid ejection head 165, the length of the wiping sheet wasted by the preliminary feeding becomes long.

On other hand, according to the embodiment in which the wiping sheet 130 is passed from below through the space between the pressing roller 163 and the cleaning liquid ejection head 165, the front surface of the wiping sheet 130 is opposed to the cleaning liquid ejection head 165, and the cleaning liquid ejected from the cleaning liquid ejection head 165 is directly applied to the front surface of the wiping sheet 130. Thus, even if the cleaning liquid ejection head 165 is arranged as close as possible to the pressing roller 163, the cleaning liquid can be applied to the entire surface of the wiping sheet 130 to wipe off the stain on the nozzle surface 44. As a result, the preliminary feeding length of the wiping sheet 130 (feeding length until that part of the wiping sheet 130 on which the cleaning liquid is applied by the cleaning liquid ejection head 165 reaches the uppermost part of the pressing roller 163) can be shortened as much as possible, and the consumption amount of the wiping sheet 130 can be reduced.

By the way, in order to prevent interference with the nozzle surface 44, the cleaning liquid ejection head 165 is arranged below a horizontal surface H (see FIG. 14B) coincident with the nozzle surface 44 in the pressed state of the wiping sheet 130 to the nozzle surface 44. Moreover, a cleaning liquid pan 173 is also positioned below the pressing roller 163 so as to be arranged on the vertical moving frame 162, and adapted to receive the cleaning liquid dropped from the wiping sheet 130, together with the cleaning liquid pan 148 of the sheet feeding unit 131.

Figure 15:
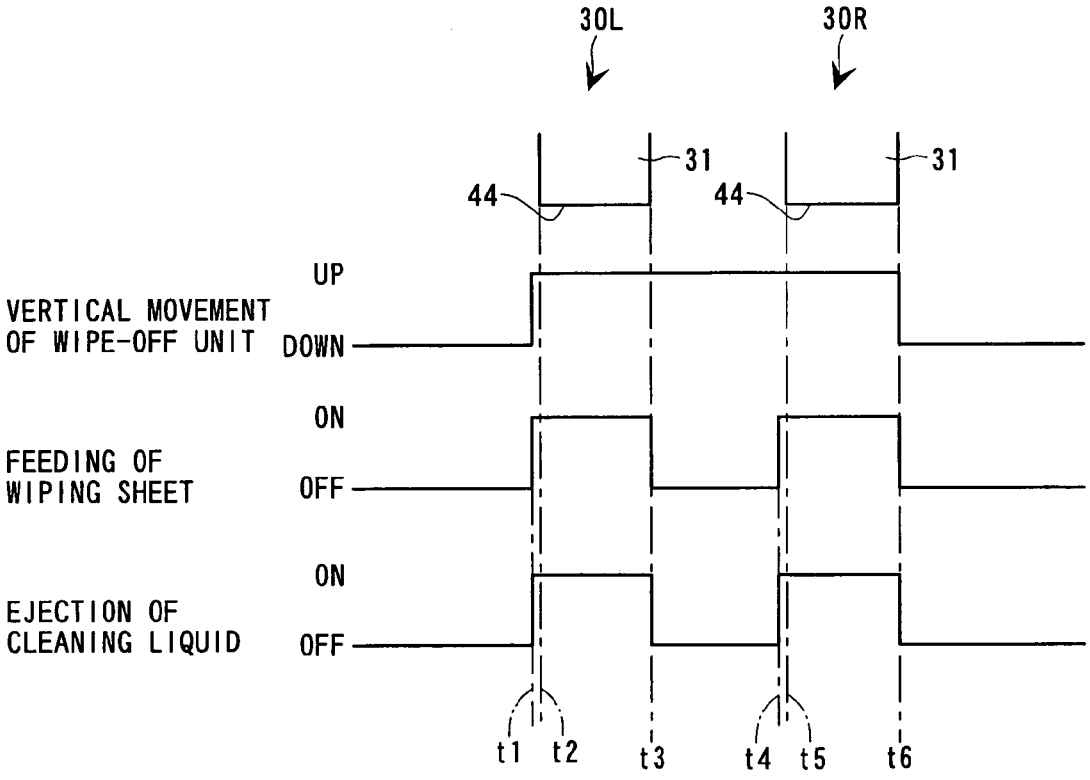
FIG. 15 is a time chart showing wiping work by the wiping unit for the embodiment.

Hereinafter, with reference to FIG. 15, a wiping work process of the nozzle surface 44 by the wiping unit 92 will be described. Upon completion of suction by the suction unit 91 of the liquid droplet ejection head 31 of the head unit 21, the motor 16 for the moving table 18 is operated to move the wipe-off unit 132 integrally with the sheet feeding unit 131 in one of the X-axis direction from the home position to the head unit 21 at the maintenance position. When the pressing roller 163 is moved to a position immediately before the liquid droplet ejection head 31 in one head row 30L of the head unit 21 (point of time t1 of FIG. 15), the forward movement of the wipe-off unit 130 is stopped, and the air cylinder 168 is operated to raise the wipe-off unit 132 to the top position.

After the raising operation, the forward movement of the wipe-off unit 132 is resumed and, simultaneously, the take-up motor 144 and the feeding motor 164 are driven to start the feeding of the wiping sheet 130, and ejection of the cleaning liquid from the cleaning liquid ejection head 165 is also started. According to this arrangement, the preliminary feeding is completed by reaching a point of time (point of time t2 in FIG. 15) at which the pressing roller 163 reaches the nozzle surface 44 of the liquid droplet ejection head 31 of the head row 30L, the wiping sheet 130 is pressed to the nozzle surface 44 in a state in which the cleaning liquid has been applied to the entire front surface, and the wiping of the nozzle surface 44 is started. Thereafter, the pressing roller 163 moves along the nozzle surface 44 to intersect the same, a new sheet part is supplied to a contact portion with the nozzle surface 44 by the feeding of the wiping sheet 130 all the time, so that the stain of the nozzle surface 44 is efficiently wiped off.

After the pressing roller 163 has intersected the nozzle surfaces 44 of all the liquid droplet ejection heads 31 belonging to the head row 30L (point of time t3 in FIG. 15), the feeding of the wiping sheet 130 and the ejection of the cleaning liquid are stopped while the forward movement of the wipe-off unit 132 is continued. Then, when the pressing roller 163 is moved to a position immediately before the liquid droplet ejection head 31 of the other head row 30R of the head unit 21 (point of time t4 in FIG. 15), the feeding of the wiping sheet 130 and the ejection of the cleaning liquid are resumed, the preliminary feeding is completed before a point of time (point of time t5 of FIG. 15) at which the pressing roller 163 reaches a nozzle surface 44 of the liquid droplet ejection head 31 of the head row 30R, and the nozzle surface 44 of the liquid droplet ejection head 31 of the head row 30L is wiped as in the above-described case. In this manner, in the movement section of the wipe-off unit 132 positioned between one head row 30L and the other head row 30R, the feeding of the wiping sheet 130 and the ejection of the cleaning liquid are stopped to prevent wasteful consumption of the wiping sheet 130 and the cleaning liquid.

After the pressing roller 163 intersects the nozzle surfaces 44 of all the liquid droplet ejection heads 31 belonging to the head row 30R, and wiping of the nozzle surfaces 44 of all the liquid droplet ejection heads 31 of the head unit 21 has been completed (point of time t6 of FIG. 15), the feeding of the wiping sheet 130 and the ejection of the cleaning liquid are stopped, the forward movement of the wipe-off unit 132 is stopped, and the wipe-off unit 132 is lowered. Then, after the lowering, the wipe-off unit 132 is moved back in the other of the X-axis direction to return to the home position. In this manner, since the wipe-off unit 132 is moved back in the lowered state as described, the wiping sheet 130 is not brought into contact with the nozzle surface 44 during the backward movement, and re-sticking of the wiped-off stain to the nozzle surface 44 can be prevented.

By the way, according to the above-described embodiment, the sheet feeding unit 131 and the wipe-off unit 132 are constituted separately and independently. However, the sheet feeding unit 131 and the wipe-off unit 132 may be integrally constituted to raise and lower the sheet feeding unit 131 integrally with the wipe-off unit 132.

Figure 16:
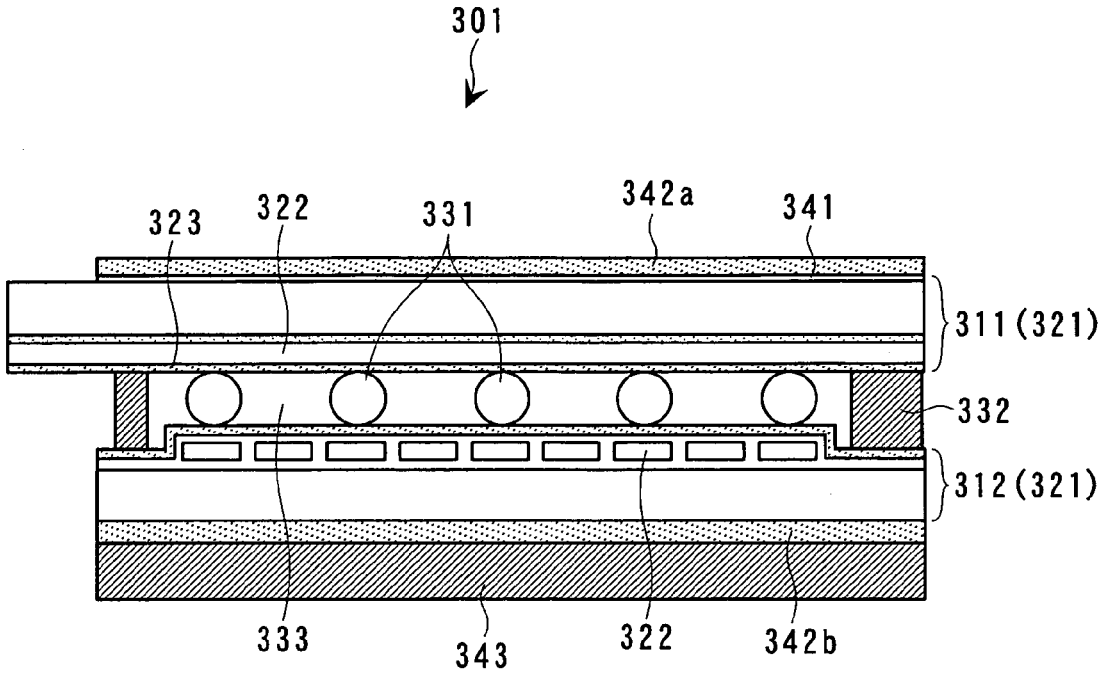
FIG. 16 is a sectional view of a liquid crystal display device manufactured by the imaging apparatus of the embodiment.

Next, a description will be made of a case in which the above-described imaging apparatus 1 is applied to the manufacturing of a liquid crystal display device. FIG. 16 shows a sectional structure of a liquid crystal display device 301. As shown in the drawing, the liquid crystal display device 301 is constituted by an upper substrate 311 and a lower substrate 312 which have glass substrates 321 as main bodies and a transparent conductive film (ITO film) 322 and an alignment layer 323 are formed on opposite surfaces, a multiplicity of spacers 331 disposed between the upper and lower substrates 311 and 312, a sealing material 332 for sealing the upper and lower substrates 311 and 312 from each other, and a liquid crystal 333 which is filled between the upper and lower substrates 311 and 312, and is constituted by laminating a phase substrate 341 and a polarizing plate 342*a* on the backside of the upper substrate 311, and also a polarizing plate 342*b* and a backlight 343 are laminated on the backside of the lower substrate 312.

In an ordinary manufacturing process, after patterning of the transparent conductive film 322 and coating of the alignment layer 323 are executed to separately manufacture the upper substrate 311 and the lower substrate 312, the spacers 331 and the sealing material 332 are formed in the lower substrate 311 and, in this state, the upper substrate 311 is stuck thereto. Subsequently, the liquid crystal 333 is injected from an injection port of the sealing material 332, and the injection port is closed. Then, the phase substrate 341, both of polarizing plates 342*a* and 342*b* and the backlight 343 are laminated.

The imaging apparatus 1 of the embodiment can be used, e.g., for formation of the spacer 331 and the injection of the liquid crystal 333. In concrete, a spacer material (e.g., ultraviolet curing resin or thermosetting resin) and liquid crystal which constitute a cell gap are introduced as a function liquid, and these are uniformly ejected (applied) to predetermined positions. First, the lower substrate 312 on which the sealing material 332 is annularly printed is set on the suction table, spacer material is ejected to the lower substrate 312 at rough intervals, and the spacer material is coagulated by irradiation with ultraviolet rays. Next, a predetermined amount of liquid crystal 333 is uniformly ejected into the inside of the sealing material 332 of the lower substrate 312. Subsequently, the separately prepared upper and lower substrates 311 and 312 on which the predetermined amount of liquid crystal has been applied are introduced in vacuum to be stuck together.

In this manner, since the liquid crystal 333 is uniformly applied (filled) in the cell before the upper and lower substrates 311 and 312 are stuck together, it is possible to solve problems such as nonspreading of the liquid crystal 333 to fine parts such as corners of the cell.

By using an ultraviolet curing resin or a thermosetting resin as the function liquid (material for the sealing material), the printing of the sealing material 332 can be performed by the imaging apparatus 1. Similarly, by introducing a polyimide resin as the function liquid (material for the alignment layer), the alignment layer 323 can be formed by the imaging apparatus 1. Moreover, by using the imaging apparatus 1 of the embodiment, the transparent conductive film 322 can also be formed.

In this manner, when the above-described imaging apparatus 1 is used for the manufacturing of the liquid crystal display device 301, the stain of the nozzle surface 44 of the liquid droplet ejection head 31 can be surely wiped off. Therefore, it is possible to prevent defective products caused by falling of the stain of the nozzle surface 44 on the workpiece.

By the way, the above-described imaging apparatus 1 can be used for the manufacturing of various electro-optical devices aside from the above-described liquid crystal display device 301 to be mounted on an electronic device such as a portable telephone, a personal computer, and the like. In other words, the imaging apparatus can be applied to the manufacturing of an organic EL device, an FED device, a PDP device, an electrophoretic display device, and the like.

Figure 17:
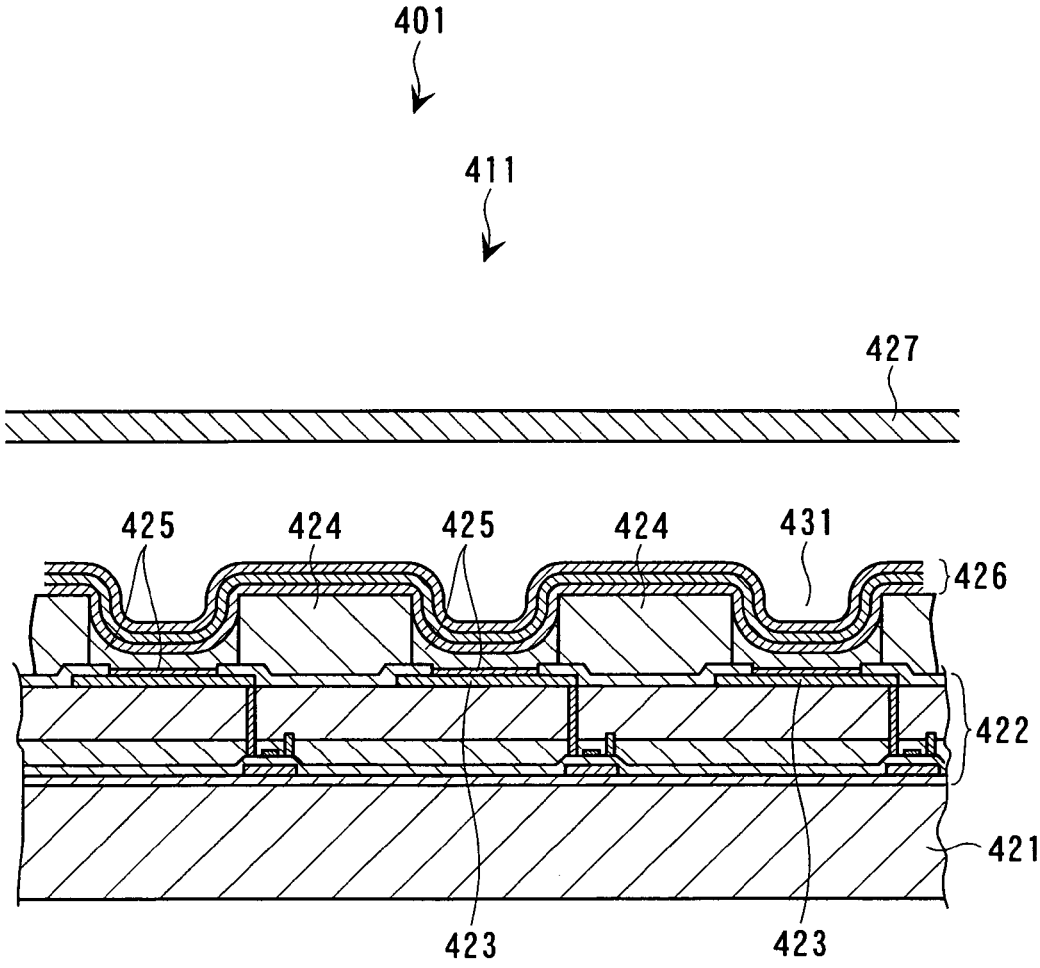
FIG. 17 is a sectional view of an organic EL device manufactured by the imaging apparatus of the embodiment.

An example of applying the imaging apparatus 1 to the manufacturing of the organic EL device will be briefly described. As shown in FIG. 17, an organic EL device 401 is constructed by connecting a wiring of a flexible board (not illustrated) and a driving IC (not illustrated) to an organic EL element 411 which is constituted by a substrate 421, a circuit element part 422, a pixel electrode 423, a bank part 424, a light emitting element 425, a cathode 426 (counter electrode), and a sealing substrate 427. The circuit element part 422 is formed on the substrate 421, and a plurality of pixel electrodes 423 are lined up on the circuit element part 422. Additionally, the bank part 424 is formed in a lattice shape between the pixel electrodes 423, and the light emitting element 425 is formed in a concave opening 431 formed by the bank part 424. The cathode 426 is formed on an upper entire surfaces of the bank part 424 and the light emitting element 425, and the sealing substrate 427 is laminated on the cathode 426.

In a manufacturing process of the organic EL device 401, after the bank part 424 is formed in predetermined positions on the substrate 421 (workpiece W) on which the circuit element part 422 and the pixel electrode 423 are formed in advance, plasma processing is performed to adequately form the light emitting element 425, and then the light emitting element 425 and the cathode 426 (counter electrode) are formed. Subsequently, after the sealing substrate 427 is laminated on the cathode 426 to seal the same, thereby obtaining the organic EL element 411, the cathode 426 of the organic EL element 411 is connected to the wiring of the flexible substrate, and the wiring of the circuit element part 422 is connected to the driving IC, whereby the organic EL device 401 is manufactured.

The imaging apparatus 1 is used for formation of the light emitting element 425. In concrete, a light emitting element material (function liquid) is introduced to the liquid droplet ejection head 31, the light emitting element material is ejected corresponding to a position of the pixel electrode 423 of the substrate 421 on which the bank part 424 has been formed, and this material is dried to form the light emitting element 425. Note that, also in the formation or the like of the pixel electrode 423 or the cathode 426, by using a corresponding liquid material, it can be formed by using the imaging apparatus 1.

Moreover, for example, according to a manufacturing method of an electron emission device, fluorescent materials of red (R), green (G) and blue (B) colors are introduced to a plurality of liquid droplet ejection heads 31, the plurality of liquid droplet ejection heads 31 are caused to perform main scanning and sub-scanning, and the fluorescent materials are selectively ejected to form a multiplicity of fluorescent bodies on the electrode.

According to a manufacturing method of a PDP device, fluorescent materials of R, G and B colors are introduced to a plurality of liquid droplet ejection heads 31, the plurality of liquid droplet ejection heads 31 are caused to perform main scanning and sub-scanning, and the fluorescent materials are selectively ejected to form fluorescent bodies in a multiplicity of concave portions on the backside substrate.

According to a manufacturing method of an electrophoretic display device, electrophoretic materials of respective colors are introduced to a plurality of liquid droplet ejection heads 31, the plurality of liquid droplet ejection heads 31 are caused to perform main scanning and sub-scanning, and the electrophoretic materials are selectively ejected to form fluorescent bodies in a multiplicity of concave portion on an electrode. An electrophoretic body which contains charged particles and dyes is preferably sealed in a microcapsule.

Further, as other electro-optical devices, devices for formation of a metal wiring, a lens, a resist, a light diffusing body, and the like, are conceivable. The liquid droplet ejection apparatus 1 of the embodiment can also be applied to such various manufacturing methods.

For example, in the metal wiring formation method, liquid metal materials are introduced to a plurality of liquid droplet ejection heads 31, the plurality of liquid droplet ejection heads 31 are caused to perform main scanning and sub-scanning, and the liquid metal materials are selectively ejected to form metal wirings on the substrate. For example, the method can be applied to a metal wiring for connecting a driver with each electrode in the above-described liquid crystal display device, or a metal wiring for connecting a thin film transistor (TFT) or the like with each electrode in the above-described organic EL device to manufacture the devices. Moreover, needless to say, the method can also be applied to a general semiconductor manufacturing technology, aside from the manufacturing of this kind of flat panel display.

In the lens formation method, lens materials are introduced to a plurality of liquid droplet ejection heads 31, the plurality of liquid droplet ejection heads 31 are caused to perform main scanning and sub-scanning, and the lens materials are selectively ejected to form a multiplicity of microlenses on the transparent substrate. For example, the method can be applied to a case of manufacturing a beam converging device in the above-described FED device. Moreover, the method can also be applied to various optical device manufacturing technologies.

In the lens manufacturing method, translucent coating materials are introduced to a plurality of liquid droplet ejection heads 31, the plurality of liquid droplet ejection heads 31 are caused to perform main scanning and sub-scanning, and the coating materials are selectively ejected to form coating films on the lens surface.

In the resist formation method, resist materials are introduced to a plurality of liquid droplet ejection heads 31, the plurality of liquid droplet ejection heads 31 are caused to perform main scanning and sub-scanning, and the resist materials are selectively ejected to form photoresists of arbitrary shapes on the substrate. For example, not only in the bank formation for the above-described various display devices but also in a photolithography method which plays a main role in a semiconductor manufacturing technology, the method can be widely applied for photoresist coating.

In the light diffusing body formation method, light diffusing materials are introduced to a plurality of liquid droplet ejection heads 31, the plurality of liquid droplet ejection heads 31 are caused to perform main scanning and sub-scanning, and the light diffusing materials are selectively ejected to form a multiplicity of light diffusing bodies on the substrate. In this case, needless to say, the method can also be applied to various optical devices.

In this manner, while there is a possibility that various kinds of function liquids will be introduced to the liquid droplet ejection apparatus 1, by using the above-described liquid droplet ejection apparatus 1 for the manufacturing of various electro-optical devices, it is possible to manufacture the electro-optical devices accurately and stably.

As described above, according to the wiping unit of this invention and the liquid droplet ejection apparatus equipped therewith, the preliminary feeding length of the wiping sheet can be shortened to the extent possible to reduce running costs without damaging the wiping performance to the liquid droplet ejection head.

According to the electro-optical device of this invention, it is possible to provide an electro-optical device and an electronic device which are high in reliability and quality because they are manufactured by using the liquid droplet ejection apparatus in which the liquid droplet ejection heads are managed in a clean state.

What is claimed is:

1. A wiping unit for a liquid droplet ejection head having:

a wipe-off unit having mounted thereon a pressing roller to press a wiping sheet to a nozzle surface of the liquid droplet ejection head; and a sheet feeding unit for feeding the wiping sheet through the pressing roller such that the wipe-off unit is moved together with the sheet feeding unit while feeding the wiping sheet in a state in which the wiping sheet is pressed to the nozzle surface, thereby carrying out a wiping operation, wherein the sheet feeding unit comprises: a supply reel having rolled thereabout the wiping sheet; a speed detection roller for feeding the wiping sheet supplied from the supply reel to the wipe-off unit; and a take-up reel for taking up the wiping sheet through the wipe-off unit.

2. The wiping unit according to claim 1, wherein the sheet feeding unit further comprises: a guide roller for feeding the wiping sheet supplied from the supply reel to the pressing roller; and a pinch roller which is disposed along a bottom side of the pressing roller so as to hold the wiping sheet between the pressing roller and the pinch roller.

* * * * *